US011202470B2

(12) United States Patent
Rabinowitz et al.

(10) Patent No.: US 11,202,470 B2
(45) Date of Patent: Dec. 21, 2021

(54) COMPOSITIONS, DEVICES, AND METHODS FOR NICOTINE AEROSOL DELIVERY

(71) Applicant: NJOY, LLC, Scottsdale, AZ (US)

(72) Inventors: Joshua Rabinowitz, Princeton, NJ (US); Mark Scatterday, Scottsdale, AZ (US)

(73) Assignee: NJOY, Inc., Scottsdale, AZ (US)

( * ) Notice: Subject to any disclaimer, the term of this patent is extended or adjusted under 35 U.S.C. 154(b) by 1169 days.

(21) Appl. No.: 14/284,194

(22) Filed: May 21, 2014

(65) Prior Publication Data

US 2014/0345635 A1 Nov. 27, 2014

Related U.S. Application Data

(60) Provisional application No. 61/971,340, filed on Mar. 27, 2014, provisional application No. 61/969,650, (Continued)

(51) Int. Cl.
*A24B 15/167* (2020.01)
*A24B 15/16* (2020.01)
(Continued)

(52) U.S. Cl.
CPC ..... *A24F 40/50* (2020.01); *A24B 15/16* (2013.01); *A24B 15/167* (2016.11); *A24F 40/10* (2020.01)

(58) Field of Classification Search
None
See application file for complete search history.

(56) References Cited

U.S. PATENT DOCUMENTS 374,584 A 12/1887 Cook
576,653 A 2/1897 Bowlby
(Continued)

FOREIGN PATENT DOCUMENTS

CN 101869356 A 10/2010
EP 0354661 A2 2/1990
(Continued)

OTHER PUBLICATIONS

Communication Relating to the Results of the Partial International Search for PCT/US2014/039016, dated Aug. 26, 2014 (7 pages).
(Continued)

*Primary Examiner* — Michael J Felton
(74) *Attorney, Agent, or Firm* — Finnegan, Henderson, Farabow, Garrett & Dunner, LLC

(57) ABSTRACT

The present disclosure generally relates to compositions, and related devices and methods, useful in vaporizing devices such as electronic cigarettes. The composition may comprise nicotine, at least one solvent, and at least one ion pairing agent, and may be vaporized to form a condensation aerosol, wherein inhalation of the aerosol allows for deposition of nicotine with the respiratory system, including deep lung deposition. The vaporizing device may comprise a vaporization unit, a battery, and an integrated circuit coupled to the battery, wherein the integrated circuit is configured to control the battery for rapid initial vaporization without overheating, producing thermal degradation products, or draining battery energy. The battery may operate with pulse width modulation for at least a portion of the time the vaporizing device is being used.

21 Claims, 16 Drawing Sheets

Related U.S. Application Data filed on Mar. 24, 2014, provisional application No. 61/856,374, filed on Jul. 19, 2013, provisional application No. 61/826,318, filed on May 22, 2013.

(51) Int. Cl.
*A24F 40/10* (2020.01)
*A24F 40/50* (2020.01)

(56) References Cited

U.S. PATENT DOCUMENTS 595,070 A 12/1897 Oldenbusch
799,844 A 9/1905 Fuller
969,076 A 8/1910 Pender
1,067,531 A 7/1913 MacGregor
1,163,183 A 12/1915 Stoll
1,299,162 A 4/1919 Fisher
1,505,748 A 3/1924 Tamis
1,552,877 A 9/1925 Phillipps et al.
1,632,335 A 6/1927 Hiering
1,706,244 A 3/1929 Meyerson
1,845,340 A 2/1932 Ritz
1,972,118 A 9/1934 McDill
1,998,683 A 4/1935 Montgomery
2,031,363 A 2/1936 Erikson
2,039,559 A 5/1936 Segal
2,327,120 A 11/1940 McCoon
2,231,909 A 2/1941 Hempel
2,460,427 A 2/1949 Musselman et al.
2,483,304 A 9/1949 Vogel
2,502,561 A 4/1950 Ebert
2,765,949 A 10/1956 Hillman
2,897,958 A 8/1959 Tarleton
3,146,937 A 9/1964 Vesak
3,420,360 A 1/1969 Young
3,567,014 A 3/1971 Feigelman
3,861,523 A 1/1975 Fountain et al.
3,941,300 A 3/1976 Troth
4,207,976 A 6/1980 Herman
4,519,319 A 5/1985 Howlett
4,771,796 A 9/1988 Myer
4,798,310 A 1/1989 Kasai et al.
4,813,536 A 3/1989 Willis
4,848,563 A 7/1989 Robbins
5,005,759 A 4/1991 Bouche
5,123,530 A 6/1992 Lee
5,269,327 A 12/1993 Counts et al.
5,605,226 A 2/1997 Hernlein
5,641,064 A 6/1997 Goserud
5,746,587 A 5/1998 Racine et al.
5,810,164 A 9/1998 Rennecamp
5,881,884 A 3/1999 Podosek
5,938,018 A 8/1999 Keaveney et al.
5,967,310 A 10/1999 Hill
5,975,415 A 11/1999 Zehnal
5,979,460 A 11/1999 Matsumura
6,269,966 B1 8/2001 Pallo et al.
6,386,371 B1 5/2002 Parsons
6,431,363 B1 8/2002 Hacker
6,446,793 B1 9/2002 Layshock
6,510,982 B2 1/2003 White et al.
6,557,708 B2 5/2003 Polacco
6,622,867 B2 9/2003 Menceles
6,672,762 B1 1/2004 Faircloth
6,726,006 B1 4/2004 Funderburk et al.
7,000,775 B2 2/2006 Gelardi
7,374,048 B2 5/2008 Mazurek
7,546,703 B2 6/2009 Johnske et al.
7,621,403 B2 11/2009 Althoff et al.
7,644,823 B2 1/2010 Gelardi et al.
7,766,013 B2 8/2010 Wensley et al.
7,815,332 B1 10/2010 Smith
7,886,507 B2 2/2011 McGuinness, Jr.
7,988,034 B2 8/2011 Pezzoli
8,141,701 B2 3/2012 Hodges
8,381,739 B2 2/2013 Gonda
8,443,534 B2 5/2013 Goodfellow et al.
8,464,867 B2 6/2013 Holloway et al.
8,539,959 B1 9/2013 Scatterday
8,595,460 B2 12/2013 Scatterday
2001/0032795 A1 10/2001 Weinstein et al.
2001/0052480 A1 12/2001 Kawaguchi et al.
2002/0043554 A1 4/2002 White et al.
2002/0175164 A1 11/2002 Dees et al.
2003/0089377 A1 5/2003 Hajaligol et al.
2004/0002520 A1 1/2004 Soderlund et al.
2004/0149624 A1 8/2004 Wischusen, III et al.
2005/0061759 A1 3/2005 Doucette
2005/0118545 A1 6/2005 Wong
2005/0145533 A1 7/2005 Seligson
2005/0172976 A1 8/2005 Newman et al.
2006/0018840 A1 1/2006 Lechuga-Ballesteros et al.
2006/0054676 A1 3/2006 Wischusen, III
2006/0150991 A1 7/2006 Lee
2006/0254948 A1 11/2006 Herbert et al.
2006/0255105 A1 11/2006 Sweet
2007/0062548 A1 3/2007 Horstmann et al.
2007/0098148 A1 5/2007 Sherman
2007/0235046 A1 10/2007 Gedevanishvili
2007/0267033 A1 11/2007 Mishra et al.
2008/0092912 A1 4/2008 Robinson et al.
2008/0138398 A1 6/2008 Gonda
2008/0241255 A1 10/2008 Rose et al.
2008/0276947 A1 11/2008 Martzel
2009/0095311 A1 4/2009 Han
2009/0267252 A1 10/2009 Ikeyama
2009/0288669 A1 11/2009 Hutchens
2010/0000672 A1 1/2010 Fogle
2010/0031968 A1 2/2010 Sheikh et al.
2010/0186757 A1 7/2010 Crooks et al.
2010/0200006 A1 8/2010 Robinson et al.
2010/0242974 A1 9/2010 Pan
2010/0275938 A1 11/2010 Roth et al.
2010/0276333 A1 11/2010 Couture
2010/0307116 A1 12/2010 Fisher
2011/0049226 A1 3/2011 Moreau et al.
2011/0155153 A1 6/2011 Thorens et al.
2011/0180433 A1 6/2011 Rennecamp
2011/0162667 A1 7/2011 Burke et al.
2011/0168194 A1 7/2011 Hon
2011/0232654 A1 9/2011 Mass
2011/0265806 A1 11/2011 Alarcon et al.
2011/0277780 A1 11/2011 Terry et al.
2011/0278189 A1 11/2011 Terry et al.
2011/0315701 A1 12/2011 Everson
2012/0060853 A1 3/2012 Robinson et al.
2012/0111347 A1 5/2012 Hon
2012/0204689 A1 8/2012 Xiu
2012/0227753 A1 9/2012 Newton
2012/0261286 A1 10/2012 Holloway et al.
2012/0267383 A1 10/2012 Van Rooyen
2012/0273589 A1 11/2012 Hon
2013/0140200 A1 6/2013 Scatterday
2013/0228191 A1 9/2013 Newton
2013/0247924 A1 9/2013 Scatterday et al.
2013/0248385 A1 9/2013 Scatterday et al.
2013/0255702 A1 10/2013 Griffith, Jr. et al.
2013/0276802 A1 10/2013 Scatterday
2013/0284190 A1 10/2013 Scatterday et al.
2013/0284191 A1 10/2013 Scatterday et al.
2013/0313139 A1 11/2013 Scatterday et al.
2013/0333712 A1 12/2013 Scatterday
2014/0000638 A1* 1/2014 Sebastian ..... A24F 47/008 131/328
2014/0096781 A1 4/2014 Sears et al.
2014/0196731 A1 7/2014 Scatterday

(56) References Cited

U.S. PATENT DOCUMENTS

| | | | |
|---|---|---|---|
| 2014/0271946 | A1 | 9/2014 | Kobal et al. |
| 2016/0044968 | A1 | 2/2016 | Bowen et al. |

FOREIGN PATENT DOCUMENTS

| | | | |
|---|---|---|---|
| EP | 1618803 | A1 | 1/2006 |
| EP | 2325093 | A1 | 5/2011 |
| JP | 2001-165437 | A | 6/2001 |
| WO | WO 97/12639 | | 4/1997 |
| WO | WO 03/094900 | A1 | 11/2003 |
| WO | WO-2006/004646 | A1 | 1/2006 |
| WO | WO-2011/033396 | A1 | 3/2011 |
| WO | WO-2011/117580 | A2 | 9/2011 |
| WO | WO-2012/021972 | A1 | 2/2012 |
| WO | WO 2012/109371 | A1 | 8/2012 |
| WO | WO 2013/141906 | | 9/2013 |
| WO | WO 2013/141907 | | 9/2013 |
| WO | WO 2013/141994 | | 9/2013 |
| WO | WO 2013/141998 | | 9/2013 |
| WO | WO 2013/142671 | | 9/2013 |
| WO | WO 2013/142678 | | 9/2013 |
| WO | WO 2014/113592 | | 7/2014 |
| WO | WO 2014/151434 | | 9/2014 |

OTHER PUBLICATIONS

Caldwell, B., et al., "A Systematic Review of Nicotine by Inhalation: Is There a Role for the Inhaled Route?," *Nicotine & Tobacco Research*, pp. 1-13 (2012).

Torrie, B., "Nicotine inhaler gives instant 'hit'," 2 pages (2013), available at http://www.stuff.co.nz/national/health/8822875/Nicotine-inhaler-gives-instant-hit.

World Health Organization, "Health Effects of Interactions Between Tobacco Use and Exposure to Other Agents," Environmental Health Criteria 211, 83 pages (1999), available at http://www.inchem.org/documents/ehc/ehc/ehc211.htm.

"A Randomised Placebo-Controlled Trial of a Nicotine Inhaler and Nicotine Patches for Smoking Cessation," 5 pages, available at http://www.otago.ac.nz/wellington/otago047634.pdf.

Third Party Observations filed in European Patent Office for corresponding European Patent Application No. 14732735.7 on Dec. 5, 2018.

* cited by examiner

COMPOSITIONS, DEVICES, AND METHODS FOR NICOTINE AEROSOL DELIVERY

CROSS-REFERENCE TO RELATED APPLICATIONS

This application claims benefit of priority to U.S. Provisional Application No. 61/826,318, filed May 22, 2013, U.S. Provisional Application No. 61/856,374, filed Jul. 19, 2013, U.S. Provisional Application No. 61/969,650, filed Mar. 24, 2014, and U.S. Provisional Application No. 61/971,340, filed Mar. 27, 2014, all of which are incorporated by reference herein in their entireties.

TECHNICAL FIELD

The present disclosure generally relates to compositions, and related devices and methods, useful in vaporizing devices such as electronic cigarettes.

BACKGROUND

Electronic cigarettes and other vaporizing and vaping devices are an increasingly popular alternative to smoking of traditional combustion cigarettes. Typically, electronic cigarettes convert a nicotine-containing liquid into a vapor for inhalation by a user. An important consideration for electronic cigarettes is obtaining sufficient deep lung delivery of nicotine. Current compositions, devices, and methods may fail to deliver nicotine to the deep lung, and instead primarily deliver nicotine to the oropharynx at the back of the throat or the upper respiratory tract. This may occur for various reasons. For example, nicotine may not be contained in the particle phase of an emitted aerosol, but instead may be a gas that diffuses into the walls of the oropharynx or upper respiratory tract. Or the nicotine may be in both the particulate and gaseous phases of the aerosol in substantial amounts, but the gaseous fraction may be too high and/or the nicotine may exchange too rapidly between the particulate and gaseous phases, such that it deposits via diffusion of gas into the walls of the oropharynx or upper respiratory tract.

Another problem in the field of electronic cigarettes and other vaporizing/vaping devices is obtaining the desired nicotine dose. For example, vaporizing devices may fail to provide consistent dosing from puff to puff, such as obtaining the same emitted dose of nicotine and the same aerosol particle size from puff to puff. Electronic cigarettes traditionally rely on having an equivalent passage of current through the heating element from puff to puff, at least to the extent the battery technology enables such consistency, and are not equipped to respond to the demands of a particular user. Other common limitations include insufficient aerosol production, slow responsiveness to user demand, risk of overheating, degradation of the substance(s) to be vaporized, inadequate battery power, and/or requirement for frequent recharging of the battery. Collectively, these limitations decrease the effectiveness of these devices. For example, current devices may provide inconsistent heating and/or insufficient aerosol generation, thus failing to simulate the familiar experience of smoking traditional cigarettes or cigars, including the familiar "draw" or ease of vapor production of a combustion cigarette.

Thus, there is a need for compositions, devices, and methods that may provide for a more satisfying experience in the use of vaporizing devices such as electronic cigarettes.

BRIEF SUMMARY

The present disclosure includes a composition comprising nicotine, at least one solvent, and at least one ion pairing agent, wherein vaporization and condensation of the composition produces an aerosol, and wherein at least 85% of the nicotine by weight with respect to the total weight of the composition is in a particulate phase of the aerosol. Embodiments of the present disclosure may include one or more of the following features: the nicotine may not be in free base form; the at least one solvent may comprise at least one alcohol chosen from glycerol, propylene glycol, polyethylene glycol, or any combination thereof; the at least one ion pairing agent may comprise a compound having at least one functional group chosen from a phosphate group or a carboxylic acid group; the at least one ion pairing agent may comprise an acid; the at least one ion pairing agent may comprise a monoprotic carboxylic acid; the at least one ion pairing agent may comprise acetic acid, pyruvic acid, lactic acid, levulinic acid, lauric acid, or any combination thereof; the at least one ion pairing agent may comprise lactic acid; a pH of the composition may be within a range of about pH 6 to about pH 9; a pH of the aerosol may be ±0.3 pH of the pH of the composition; the composition may comprise at least one agent chosen from menthol, a tobacco alkaloid compound, or a combination thereof; the composition may comprise from about 1.5% to about 6.0% nicotine, from about 44% to about 48% glycerol, and from about 44% to about 48% propylene glycol, by weight with respect to the total weight of the composition; the composition may comprise from about 2.5% to about 5.0% nicotine, from about 44% to about 48% glycerol, and from about 44% to about 48% propylene glycol, by weight with respect to the total weight of the composition; the at least one ion pairing agent may have a molar ratio with respect to nicotine ranging from about 1:2 to about 1:1 (ion pairing agent:nicotine); and/or the at least one ion pairing agent may comprise lactic acid; the composition may comprise from about 0.5% to about 3.0% of at least one agent chosen from menthol, a tobacco alkaloid compound, a non-tobacco flavor, or a combination thereof, by weight with respect to the total weight of the composition.

The present disclosure also includes an aerosol comprising nicotine, at least one solvent, and at least one ion pairing agent, wherein the aerosol is produced by vaporization and condensation of a composition comprising nicotine, the at least one solvent, and the at least one ion pairing agent, and wherein at least 85% of the nicotine by weight with respect to the total weight of the composition is in a particulate phase of the aerosol. Embodiments of the present disclosure may include one or more or the following features: the aerosol may comprise a plurality of particles having a mass median aerodynamic diameter between about 200 nm and about 4 μm; the particles may have a mass median aerodynamic diameter between about 500 nm and about 1 μm; at least 88% of the nicotine by weight with respect to the total weight of the composition may be in the particulate phase of the aerosol; and/or the at least one ion pairing agent may have a molar ratio with respect to nicotine ranging from about 1:2 to about 1:1 (ion pairing agent:nicotine).

The present disclosure further includes a device for delivery of an aerosol, the device comprising a heating element and a composition comprising nicotine, at least one solvent, and at least one ion pairing agent chosen from lactic acid, levulinic acid, lauric acid, or any combination thereof; wherein the composition comprises a liquid and the heating element provides heat to the liquid to form an aerosol. Embodiments of the present disclosure may include one or more of the following features: the pH of the composition may be within a range of about pH 6 to about pH 9; from about 85% to about 95% of the nicotine by weight with respect to the total weight of the composition may be in a particulate phase of the aerosol; at least 90% of the nicotine by weight with respect to the total weight of the composition may be in the particulate phase of the aerosol; the device may comprise a battery and a reservoir, wherein the battery is coupled to the heating element, and wherein the reservoir comprises the liquid; the reservoir may comprise an absorbent material; and/or the device may be an electronic cigarette.

The present disclosure further includes a method of producing an aerosol, the method comprising: heating and vaporizing a composition, wherein the composition comprises nicotine, at least one solvent, and at least one monoprotic carboxylic acid ion pairing agent, wherein the vaporized composition forms an aerosol, and wherein at least 50% of the nicotine by weight with respect to the total weight of the composition is in a particulate phase of the aerosol. Embodiments of the present disclosure may include one or more of the following features: formation of the aerosol may comprise spontaneous condensation; from about 85% to about 95% of the nicotine by weight with respect to the total weight of the composition may be in the particulate phase of the aerosol; the method may comprise delivering the aerosol to a human body, wherein greater than about 50% of the nicotine by weight with respect to the total weight of the composition is absorbed by the body in less than about 2 minutes, the aerosol may be delivered via inhalation to a lung; and/or the method may comprise delivering the aerosol to a human body by inhalation, wherein a peak plasma concentration of nicotine in blood is achieved within about 120 seconds of completion of inhalation.

The present disclosure further includes a composition comprising nicotine, at least one solvent, and at least one ion pairing agent, wherein vaporization and condensation of the composition produces an aerosol, and wherein the at least one ion pairing agent has a molar ratio with respect to nicotine ranging from about 1:2 to about 1:1 (ion pairing agent:nicotine). In some embodiments, the at least one ion pairing agent may comprise a monoprotic carboxylic acid.

The present disclosure further includes a composition comprising nicotine, at least one solvent, and at least one ion pairing agent comprising at least one carboxylic acid group, wherein vaporization and condensation of the composition produces an aerosol, and wherein the at least one ion pairing agent has an acid group molar ratio with respect to nicotine ranging from about 1:2 to about 1:1 (carboxylic acid group(s) of ion pairing agent:nicotine). In some embodiments, the at least one ion pairing agent may comprise a monoprotic carboxylic acid.

The present disclosure further includes a device for delivery of an aerosol, the device comprising: a heating element; a sensor for detecting activation of the device; a microprocessor; and a composition comprising nicotine; wherein the microprocessor is configured to supply a first amount of current greater than zero to the heating element upon activation of the device for a first interval of time, and a second amount of current different from the first amount of current for a second interval of time. Embodiments of the present disclosure may include one or more of the following features: the sensor may be configured to detect one or more inhalation characteristics chosen from a duration of inhalation, a pressure change due to inhalation, and an extent of airflow during inhalation; the first amount of current may be greater than the second amount of current; the first amount of current or the second amount of current may be based at least in part on a history of activation of the device prior to the activation; the device may include a battery, and the history of activation of the device may include an amount of time that the battery has been in operation; the microprocessor may be configured to supply the first amount of current or the second amount of current to the heating element based at least in part on a temperature of the heating element or a characteristic of the composition; the characteristic of the composition may include a temperature of the composition or a thermal stability of the composition; the second amount of current may be chosen to reduce degradation of at least one chemical component of the composition relative to an amount of degradation caused by the first amount of current during a combined interval of time of the first and second intervals of time; the first interval of time may be less than about 1 second; and/or the combined interval of time may correspond to a single actuation of the device.

The present disclosure further includes a method of delivering an aerosol comprising nicotine from a vaporizing device, the vaporizing device including a battery, a heating element, and a composition comprising nicotine, the method comprising: modulating an amount of heat supplied to the composition based on at least one of a history of activation of the vaporizing device, a prior inhalation characteristic of the vaporizing device, a temperature of the composition, or a temperature of the heating element. Embodiments of the present disclosure may include one or more of the following features: the history of activation of the device may include an amount of time that the battery has been in operation, and modulating the amount of heat supplied to the composition may be based at least in part on the amount of time that the battery has been in operation; and/or the vaporizing device may include a sensor, the method further comprising detecting a first activation state of the vaporizing device with the sensor upon inhalation of the vaporizing device, wherein modulating the amount of heat supplied to the composition may occur after the sensor detects the first activation state.

The present disclosure further includes a vaporizing device comprising: a vaporization unit; a battery coupled to the vaporization unit; and an integrated circuit coupled to the battery; wherein the integrated circuit is configured to control operation of the battery in at least two different operating modes. Embodiments of the present disclosure may include one or more of the following features: the integrated circuit may be configured to control the battery based on at least one characteristic of the battery; the at least one characteristic of the battery may include information related to a prior use or a current use of the battery; the at least one characteristic of the battery may include a voltage of the battery, a current of the battery, a resistance of the battery, an age of the battery, or a previous amount of use of the battery; at least one of the operating modes may include operating with pulse width modulation; at least one of the operating modes may include operating the battery at a non-modulated voltage; the integrated circuit may include an algorithm to maintain a substantially constant effective voltage of the battery or to maintain a substantially constant rate of vaporization of the vaporizing device over an amount of time; the integrated circuit may include at least one sensor; the at least one sensor may include a pressure sensor, a flow rate sensor, a motion sensor, an electrical current sensor, or an electrical resistance sensor; and/or the vaporization unit may include a liquid comprising nicotine, and the integrated circuit may include an algorithm to maintain a substantially constant vaporization rate of nicotine over an amount of time.

The present disclosure further includes a vaporizing device comprising: a vaporization unit including a heating element; a battery coupled to the heating element; and an integrated circuit coupled to the battery, wherein the integrated circuit includes a processor and a sensor; wherein the integrated circuit is configured to control operation of the battery in at least two operating modes, at least one of the operating modes including operating with pulse width modulation. Embodiments of the present disclosure may include one or more of the following features: the integrated circuit may be configured to control operation of the battery in a first operating mode at a non-modulated voltage and a second operating mode with pulse width modulation; the integrated circuit may be configured to control operation of the battery in a first operating mode at a first effective voltage and a second operating mode at a second effective voltage, wherein the second effective voltage may be greater than zero and less than the first effective voltage; and/or the integrated circuit may include at least one of a transmitter and a memory; at least one of the processor and the memory may include an algorithm for determining a set of operating parameters of the battery, the set of operating parameters including the at least two operating modes.

The present disclosure further includes a method of controlling battery power in a vaporizing device, the vaporizing device including a battery and an integrated circuit coupled to the battery, the method comprising: operating the battery in a first operating mode for a first period of time; and operating the battery in a second operating mode different from the first operating mode for a second period of time; wherein at least one of the first or the second operating modes includes operating with pulse width modulation, and wherein the first period of time is less than about 2 seconds. Embodiments of the present disclosure may include one or more of the following features: the first operating mode or the second operating mode may include operating the battery at a non-modulated voltage; the vaporizing device may include at least one sensor, the method further comprising: detecting a pressure difference of the vaporizing device with the at least one sensor, and initiating the first operating mode after detecting the pressure difference; wherein the first period of time may coincide with inhalation of the vaporizing device by a user; the method may comprise receiving information related to a usage characteristic of the battery with the integrated circuit, and determining a length of the first period of time or the second period of time based on the information; and/or the information may include a voltage of the battery, a current of the battery, a resistance of the battery, an age of the battery, a previous amount of use of the battery, or a combination thereof.

DETAILED DESCRIPTION

Figure 1A:
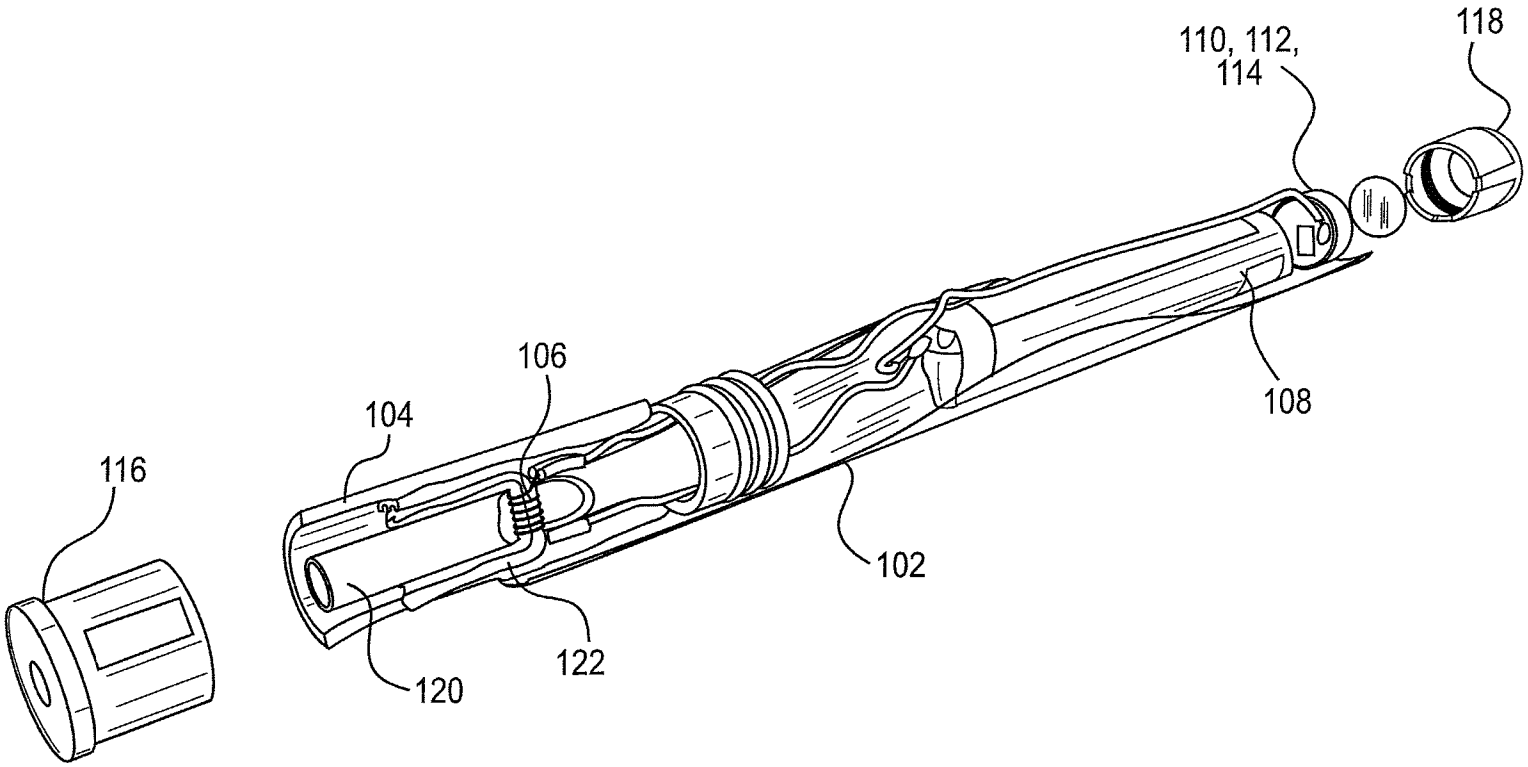
FIG. 1A shows an exploded, partial cross-section view of an exemplary electronic cigarette.

Particular aspects of the present disclosure are described in greater detail below. The terms and definitions as used and clarified herein are intended to represent the meaning within the present disclosure. The patent literature referred to herein is hereby incorporated by reference. The terms and definitions provided herein control, if in conflict with terms and/or definitions incorporated by reference.

The singular forms "a," "an," and "the" include plural reference unless the context dictates otherwise.

The terms "approximately" and "about" refer to being nearly the same as a referenced number or value. As used herein, the terms "approximately" and "about" generally should be understood to encompass ±10% of a specified amount or value.

Compositions according to the present disclosure may comprise nicotine, at least one solvent, and at least one ion pairing agent. Embodiments of the present disclosure may allow for control over the pH of a composition and/or partitioning of compounds between the gaseous phase and particulate phase of an aerosol formed from the composition, e.g., by vaporization and condensation of the composition via use of a vaporizing device, e.g., an electronic cigarette. In some embodiments, use of an ion pairing agent in a composition comprising nicotine may provide for control over, or otherwise affect, deposition of the nicotine in the body. Embodiments of the present disclosure further include devices and containers comprising compositions for generating aerosol, methods of optimizing battery performance, and methods of varying nicotine dose, e.g., according to user demand.

Nicotine

Compositions of the present disclosure may comprise nicotine. The nicotine may be derived or obtained from chemical synthesis, from tobacco, and/or from a natural or engineered biological source. Nicotine may be introduced into the composition in free base and/or salt form. Exemplary salts suitable for the compositions herein include nicotine hydrogen tartrate salt and nicotine hemisulfate salt. The compositions disclosed herein may allow for uptake of nicotine by the body, e.g., within the respiratory system, without also introducing into the body harmful compounds present in tobacco. Some embodiments of the present disclosure may not include nicotine, e.g., and may include one or more flavors as described below. Other embodiments may include nicotine in combination with one or more flavors.

The amount of nicotine in the composition may range from about 0.1% to about 10% by weight with respect to the total weight of the composition. For example, the composition may comprise from about 0.1% to about 8%, or from about 0.5% to about 4%, such as about 2% nicotine by weight with respect to the total weight of the composition. In some embodiments of the present disclosure, a higher amount of nicotine may be delivered to the body than previously possible, e.g., via aerosols produced from compositions comprising from about 5% to about 10% of nicotine, by weight with respect to the total weight of the composition. In at least one embodiment, the composition may comprise from about 5% to about 8% nicotine by weight with respect to the total weight of the composition. In some embodiments, the composition may comprise about 0.5%, about 1.0%, about 1.5%, about 2.0%, about 2.5%, about 3.0%, about 3.5%, about 4.0%, about 4.5%, about 5.0%, about 5.5%, about 6.0%, about 6.5%, about 7.0%, about 7.5%, about 8.0%, about 8.5%, about 9.0%, about 9.5%, or about 10.0% nicotine by weight with respect to the total weight of the composition.

Solvents

Solvents suitable for the present disclosure may include organic and/or inorganic compounds. For example, the solvent(s) may include one or more organic compounds such as, e.g., $C_2$-$C_{20}$ compounds (i.e., compounds having 2, 3, 4, 5, 6, 7, 8, 9, 10, 11, 12, 13, 14, 15, 16, 17, 18, 19, or 20 carbons), including $C_2$-$C_{20}$ compounds having at least one functional group. Exemplary solvents include, but are not limited to, alcohols, fatty acid esters (e.g., methyl, ethyl, and propyl esters), ethers, water, and surfactants. In some embodiments, for example, the composition may comprise a solvent comprising one or more alcohol functional groups, such as an organic alcohol. Non-limiting examples include glycerol (glycerin), propylene glycol, and polyethylene glycol (e.g., PEG 400). Certain non-alcohol solvents also may be suitable. For example, the composition may comprise one or more fatty acid ester compounds, such as methyl or ester compounds, e.g., octanoic acid methyl ester and/or other $C_2$-$C_{20}$ fatty acid esters or ethers. Compositions according to the present disclosure may comprise one solvent or a mixture of two or more solvents such as a mixture of, e.g., two, three, four, or more solvents. In some embodiments, for example, the composition may comprise a mixture of glycerol and propylene glycol or a mixture of glycerol and polyethylene glycol. In some embodiments, the solvent may comprise an approximately equal mixture (on a mass percentage basis) of glycerol and propylene glycol. In other embodiments, the composition may comprise only glycerol or only propylene glycol.

The amount of solvent(s) in the composition may range from about 25% to about 99.5% by weight with respect to the total weight of the composition. For example, the composition may comprise from about 50% to about 99.5%, from about 80% to about 98%, from about 85% to about 97.5%, or from about 88% to about 95% of a solvent or solvent mixture. In some embodiments, the composition may comprise up to about 90% or may comprise about 90% of solvent(s) by weight with respect to the total weight of the composition.

The relative fractions of solvents in a solvent mixture may vary. In some embodiments, the solvent mixture may comprise equal amounts of two or more different solvents, e.g., a 1:1 ratio or mixture. For example, the composition may comprise a solvent mixture wherein each of two solvents comprises at least 25%, at least 30%, at least 35%, at least 40%, or at least 45% by weight with respect to the total weight of the composition, or a solvent mixture wherein each of three solvents comprises at least 25%, at least 27%, or at least 30% by weight with respect to the total weight of the composition. In some embodiments, the composition may comprise a mixture of about 45% glycerol by weight and about 45% propylene glycol by weight, or a mixture of about 47% glycerol by weight and about 47% propylene glycol by weight with respect to the total weight of the composition. In another embodiment, the composition may comprise a mixture of about 45% glycerol by weight and about 45% polyethylene glycol by weight with respect to the total weight of the composition. Other mixtures and/or ratios of solvents may be suitable, such as, e.g., about 3:2, about 2:1, about 3:1, about 4:1, about 5:1, about 6:1, about 7:1, about 8:1, about 9:1, or about 10:1. The choice of solvent or solvent mixture suitable for a particular composition may be made based on the disclosure herein in combination with general knowledge in the art.

Ion Pairing Agent

The composition may comprise one or more ion pairing agents, e.g., for forming an ion pair with nicotine to achieve a desired partitioning of nicotine within the aerosol. As used herein, the term "ion pairing agent" includes any ionizable agent such as, e.g., acids, bases, and ionizable buffering agents, that are capable of forming an ion pair with another ion. The choice of ion pairing agent(s) may be determined based on the nature, chemical properties, and/or physical properties of a given ion pairing agent; compatibility between the ion pairing agent and one or more other ions present in the composition such as nicotine; taste and smell; ability for the ion pairing agent to affect or adjust the pH of the composition; ability of the ion pairing agent to vaporize and to co-vaporize with nicotine; and/or based on a subsequent or intended form or use of the composition, such as in an electronic cigarette or other vaporization device.

In an electronic cigarette, for example, the ion pairing agent may be chosen at least in part to achieve a particular pH or pH range of the composition. A proper choice of ion pairing agent and/or composition pH may enhance the shelf life stability of the composition and/or electronic cigarette. For example, the composition pH may be chosen and/or controlled to minimize chemical degradation of one or more components of the composition. Further, for example, the ion pairing agent may be chosen to minimize the loss of nicotine and/or other volatile components of the composition, such as via off-gassing. Proper selection of ion pairing agent(s) also may affect the vaporization process, e.g., by enhancing or otherwise controlling aerosol formation. For example, the proper ion pair(s) may ensure that vaporization of the composition occurs at an appropriate temperature, e.g., to obtain a condensation aerosol of a desired particle size or size range, and may avoid unwanted degradation of nicotine and/or other components of the composition during the vaporization process.

Without being bound by theory, it is believed that the chemical environment of nicotine, e.g., acidic vs. basic conditions and ability to form an ionic pair with another compound, may affect partitioning of nicotine between the gaseous and particulate phases of an aerosol, ultimately affecting the deposition of nicotine in the body, e.g., within the respiratory system, such as within the deep lung. For example, the presence of an ion pairing agent may affect the equilibrium between the free base and cationic (salt) forms of nicotine. The free base form tends to convert more quickly from the particulate phase to the gaseous phase of the aerosol than the ionic form. Thus, ion pairing with nicotine may affect the exchange of nicotine between the particulate and gaseous phases of an aerosol, and ultimately control or otherwise affect deposition of nicotine in the body.

The pH of a composition may be determined according to the Henderson-Hasselbach equation:

$$\mathrm{pH} = pK_a - \log\left(\frac{[HA^+]}{[A]}\right)$$

where [A] represents the molar concentration of an ionizable substance in the composition, $[HA^+]$ represents the molar concentration of the conjugate acid of A, and $pK_a$ is the known acid dissociation constant for $HA^+$. Nicotine is an ionizable substance with a $pK_a$=8.02. Thus, for example, A may refer to nicotine free base and $HA^+$ may refer to the conjugate acid of nicotine, wherein the acid protonation occurs on the pyrrolidine ring. The nicotine accordingly will accept a proton from any acid present with a $pK_a$ less than 8.02, forming the conjugate acid of nicotine, which is a cation. In current electronic cigarette and vaporizing/vaping e-liquid compositions, it is common for no such acid to be provided and the nicotine resides in free base form, which renders it highly volatile and leads to propensity for vaporized nicotine to remain in or reenter the gas phase, rather than residing in the particulate phase of a condensation aerosol. Alternatively, the amount of whatever acid is present may be insufficient (e.g., less than about a 1:2 molar ratio with respect to nicotine), or may fail to co-vaporize with the nicotine, thereby resulting in the propensity for vaporized nicotine to remain in and/or reenter the gas phase of the aerosol. Such volatility may limit the extent to which nicotine may enter the respiratory system, e.g., beyond the oropharynx. Pulmonary absorption typically occurs faster than absorption through mucosal membranes in the mouth, such that greater absorption within the lung may provide users with a more immediate sensory response to nicotine. An amount of nicotine uptake within the throat may be beneficial to users to provide a "throat hit" experience associated with smoking traditional cigarettes. Too much uptake within the throat, however, may cause unwanted irritation. To maximize user experience, the gas/particle partitioning of nicotine may be optimized according to the present disclosure to provide for deep lung deposition while generating a desirable amount of throat hit without irritation.

The pH of a composition or collection of particles may be measured by mixing the composition or particles with a quantity of water, e.g., to test the pH with a pH meter. For example, the composition or particles may be mixed with a quantity of water in a volume-to-volume ratio (composition: water) of about 1:1 (equal quantities), about 1:2, about 1:3, about 1:4, about 1:5, about 1:6, about 1:7, about 1:8, about 1:9, or about 1:10 to determine pH.

Within the context of the present disclosure, and unless otherwise specified, the pH value of a non-aqueous composition is understood to mean the pH of a 1:3 ratio by volume of the non-aqueous composition to water, i.e., 1 part non-aqueous composition to 3 parts water. The type and amount of ion pairing agent(s) may be chosen to result in a composition and/or particle pH within a range of about pH 5 to about pH 11, such as within a range of about pH 6 to about pH 9, for example within a range of about pH 7 to about pH 8. As one of ordinary skill in the art would recognize, the pH of a composition and the pH of aerosol particles produced from that composition (e.g., via vaporization and condensation) may not be the same, depending upon the nature of the ingredients or components of the composition. In some embodiments of the present disclosure, the composition ingredients may be chosen to provide for substantially the same pH in the composition as in an aerosol produced from the composition, e.g., pH values that are within +0.5 pH of each other, within ±0.3 pH, within +0.2 pH, or within ±0.1 pH of each other. For example, a composition having a pH of about 7.8 may generate an aerosol having a pH of about 7.7 or vice versa.

In some embodiments, the composition and/or particles may have a pH of about 6, about 6.5, about 7, about 7.1, about 7.2, about 7.3, about 7.4, about 7.5, about 7.6, about 7.7, about 7.8, about 7.9, about 8, about 8.5, or about 9. In at least one embodiment, the pH of the composition and/or particles may range from about pH 7.3 to about pH 8, from about pH 7.6 to about pH 7.9, or from about pH 7.7 to about pH 7.8. In some embodiments, the ion pairing agent(s) may be chosen to provide a composition having a pH greater than about pH 5, e.g., a pH greater than about pH 5 and less than about pH 11. For example, the composition and/or particles may have a pH greater than about pH 5.5, greater than about pH 6.0, greater than about pH 6.5, greater than about pH 6.8, greater than about pH 7.0, greater than about pH 7.2, greater than about pH 7.4, greater than about pH 8.0, greater than about pH 8.5, or greater than about pH 9.0. Moreover, the pH may be chosen to be less than about pH 11.0, less than about pH 10.0, less than about pH 9.5, less than about pH 9.0, less than about pH 8.5, less than about pH 8.0, less than about pH 7.6, less than about pH 7.4, less than about pH 7.2, less than about pH 7.0, less than about pH 6.8, less than about pH 6.5, or less than about pH 6.0. The pH level may be adjusted, for example by adding an amount of one or more acids to decrease the pH, and/or by adding an amount of one or more bases to increase the pH.

Examples of ion pairing agents suitable for the present disclosure include, but are not limited to, inorganic acids (strong or weak), organic acids, any other volatile acids or pharmaceutically-acceptable acids such as acids currently used in any pharmaceutical formulation; and ammonium salts. Exemplary inorganic acids include hydrochloric acid (HCl), sulfuric acid ($H_2SO_4$), phosphoric acid ($H_3PO_4$), sodium dihydrogen phosphate ($NaH_2PO_4$), potassium dihydrogen phosphate ($KH_2PO_4$), and carbonic acid ($H_2CO_3$). Exemplary organic acids include carboxylic acids such as monoprotic carboxylic acids (e.g., acetic acid, pyruvic acid, lactic acid, levulinic acid, lauric acid, palmitic acid, stearic acid, benzoic acid, salicylic acid, gallic acid, etc.), diprotic carboxylic acids (e.g., malic acid, oxaloacetic acid, oxalic acid, malonic acid, tartaric acid, etc.), and triprotic acids (e.g., citric acid). In some embodiments, the ion pairing agent may comprise at least one monoprotic carboxylic acid. Monoprotic carboxylic acids as ion paring agents may, for example, provide one or more benefits or advantages over diprotic or triprotic carboxylic acids. Such benefits may include enhanced vaporization and/or co-vaporization with nicotine. In some embodiments, the ion pairing agent may not comprise a triprotic carboxylic acid and/or may not comprise a diprotic carboxylic acid. In some embodiments, the ion pairing agent may not comprise citric acid. In some embodiments, the ion pairing agent may not comprise an inorganic acid. The ion pairing agent may comprise a single enantiomer of a compound, e.g., a D-enantiomer or an L-enantiomer, or may comprise any combination of enantiomers, e.g., a racemic mixture or other enantiomeric mixture. For example, the ion pairing agent may comprise a D/L-mixture, such as D/L-lactic acid.

In some embodiments, the ion pairing agent may be heated, e.g., above a melting point or melting range of the ion pairing agent, before being added with one or more other components of the composition. Considerations in selection of the ion pairing agent may include its $pK_a$ value, relative stability, safety, biocompatibility, tolerability, volatility, smell, taste, and/or interaction with one or more other components of the composition such as, e.g., nicotine.

In at least some embodiments of the present disclosure, the mole fraction of the ion pairing agent is within a range of threefold more or threefold less than the mole fraction of nicotine. For example, the molar ratio of ion pairing agent to nicotine (ion pairing agent:nicotine) may range from about 1:3 to about 3:1, such as about from about 2:3 to about 7:8, from about 3:4 to about 5:6, or from about 1:2 to about 1:1. In some embodiments, the molar ratio of ion pairing agent to nicotine may be less than 1:1, such as a molar ratio of about 1:2, about 1:3, about 1:4, about 2:3,about 2:5, about 3:4, about 3:5, about 3:7, about 3:8, about 4:5, about 4:7, about 4:9, about 5:6, about 5:7, about 5:8, about 5:9, about 6:7, about 7:8, about 7:9, about 8:9, or about 9:10. In some embodiments, the molar ratio of ion pairing agent to nicotine may be about 1:1 or about 1.1:1.

In some embodiments, e.g., when the ion pairing agent includes a carboxylic acid group (e.g., a monoprotic carboxylic acid, a diprotic carboxylic acid, or a triprotic carboxylic acid), the amount of ion pairing agent with respect to nicotine may be determined from the molar ratio of the carboxylic acids group(s) of the ion pairing agent to nicotine. As used herein the term "acid group molar ratio" means the molar ratio of the carboxylic acid group(s) of a first compound (e.g., an ion pairing agent) to a second compound (e.g., nicotine). In some embodiments, the acid group molar ratio of ion pairing agent to nicotine (carboxylic acid group(s) of ion pairing agent:nicotine) may range from about 1:3 to about 3:1, such as about from about 2:3 to about 7:8, from about 3:4 to about 5:6, or from about 1:2 to about 1:1. In some embodiments, the acid group molar ratio may be less than 1:1, such as an acid group molar ratio of about 1:2, about 1:3, about 1:4, about 2:3,about 2:5, about 3:4, about 3:5, about 3:7, about 3:8, about 4:5, about 4:7, about 4:9, about 5:6, about 5:7, about 5:8, about 5:9, about 6:7, about 7:8, about 7:9, about 8:9, or about 9:10. In some embodiments, the acid group molar ratio may be about 1:1 or about 1.1:1. In at least one embodiment, for example, the composition may comprise nicotine and a monoprotic carboxylic acid as an ion pairing agent, wherein the acid group molar ratio ranges from about 1:2 to about 1:1 (carboxylic acid group(s) of ion pairing agent:nicotine).

In at least one embodiment of the present disclosure, the composition may comprise one or more volatile acids as ion pairing agent(s), which may co-vaporize with nicotine and co-condense into the particle phase of an aerosol, thereby appropriately maintaining the desired pH both in the initial composition (e.g., in an electronic cigarette or other vaporization device) and in the resulting condensation aerosol. In another embodiment, the composition may comprise one or more ion pairing agents that may degrade upon heating, e.g., into two or more safe and tolerable compounds. For example, an ion pairing agent such as oxaloacetic acid may degrade upon heating by breaking of the carbon-carbon bond beta to the carbonyl moiety to yield pyruvic acid and $CO_2$, which are both generally tolerable substances that can provide advantageous ion pairing in the resulting aerosol. Thus, in some embodiments, the composition may comprise at least one ion pairing agent having a carbonyl functional group and a carboxylic acid functional group positioned beta to the carbonyl group. In general, the amount of the ion pairing agent(s) may be chosen so as to achieve the desired composition pH, wherein the composition also comprises nicotine and any optional flavors and/or fragrances that are selected.

Other Agent(s)

The composition may comprise up to about 10% of one or more other agents (i.e., agents other than nicotine or ion pairing agents), including, but not limited to, one or more flavoring and/or fragrance agents, active agents (including, e.g., pharmacologically-active agents), preservatives, and/or tobacco alkaloid compounds other than nicotine. Without being bound by theory, it is believed that tobacco alkaloid compound(s) may serve as active agent(s), e.g., having an effect on the body, and/or may serve as fragrance or flavoring agents. Examples of other agents suitable for the present disclosure include, but are not limited to, menthol, caffeine, and tobacco alkaloid compounds such as, e.g., nornicotine, myosmine, anabasine, nicotyrine, metanicotine, anatabine, nornicotyrine, and cotinine. In some embodiments, the flavoring agents may include tobacco or non-tobacco flavors. For example, the compositions may include flavors chosen from fruit, dessert, candy, coffee, a drink or beverage flavor, alcohol, menthol, energy flavors, spice, tea, and any combinations thereof. Exemplary flavors include fruit flavors (e.g., lime, lemon, orange, apple, banana, peach, pear, dragon fruit, pineapple, kiwi, pomegranate, melon, watermelon, cantaloupe, honeydew, grapefruit, mango, berry, strawberry, raspberry, blueberry, blueberry pomegranate, cherry, grape, blackberry, and other fruits), green tea, ginger, black tea, coffee, espresso, waffle, bourbon, and vanilla, whose flavors and fragrances can be produced using combinations of chemicals generally known in the art. Exemplary dessert flavors may include chocolate, cocoa, caramel, mint, vanilla, marshmallow, cinnamon, coconut, hazelnut, butter pecan, cheesecake, dulce de leche, toffee, butterscotch, cinnamon menthol, cream, cookie, apple pie, peanut butter, vanilla custard, maple, honey, peppermint, mint chocolate, candy bar, cake, chocolate chip, strawberry and cream, strawberry and coconut, banana cream, banana nut, orange creamsicle, apple mint, apple cinnamon, and other dessert flavors. In some embodiments, the flavors may include alcohol flavors including liqueurs (e.g., bourbon, rum, tequila, scotch, crème de menthe, amaretto, and other alcohol flavors). Exemplary preservatives include chelating agents such as ethylenediaminetetraacetic acid (EDTA), bipyridine, terpyridine, ethylene diamine, and tri- and tetradentate versions ethylene diamine, as well as antioxidants such as butylated hydroxytoluene (BHT) and butylated hydroxyanisole (BHA). In some embodiments, the composition may comprise a chelating agent included or embedded in a resin such as Ecosorb. In some embodiments, for example, the composition may comprise nicotine, at least one ion pairing agent, and at least one other agent such as menthol, a flavoring agent, a preservative, and/or tobacco alkaloid compounds. In at least one embodiment, the composition may comprise a mixture of anatabine, myosmine, and anabasine. Some embodiments of the present disclosure may comprise nicotine and one or more flavoring agents (e.g., a combination of nicotine and flavoring agent(s)) or one or more flavoring agents without nicotine (e.g., a non-nicotine composition comprising one or more flavoring agents).

In some embodiments, the composition may comprise from about 0.1% to about 10%, from about 0.5% to about 7.5%, or about 2.5% to about 5.0% of other agents, by weight with respect to the total weight of the composition.

In some embodiments, for example, the composition may comprise less than about 5%, such as less than about 2% or less than about 1% of other agents. Compositions according to the present disclosure may comprise about 0.1%, about 0.2%, about 0.5%, about 0.7%, or about 1.0% of other agents. The molar ratio of other agent to nicotine may range from about 1:1 to about 1:400 (other agent:nicotine), such as from about 1:2 to about 1:200, e.g., a molar ratio of about 1:2, 1:4, 1:5, 1:8, 1:10, 1:15, 1:20, 1:30, 1:40, about 1:50, about 1:60, about 1:70, about 1:80, about 1:90, about 1:100, about 1:150, about 1:200, about 1:250, about 1:300, about 1:350, or about 1:400. The composition may comprise different quantities of other agents, e.g., a first other agent in a molar ratio of about 1:50 and a second other agent in a ratio of about 1:100 with respect to nicotine, or, e.g., a first other agent in a molar ratio of about 1:40, a second other agent in a molar ratio of about 1:40, and a third other agent in a molar ratio of about 1:300 with respect to nicotine.

When agents other than nicotine and ion-pairing agents are present in relatively substantive amounts, e.g., greater than or equal to about 10% the amount of nicotine by weight, the pH of the composition may be adjusted to account for acid-base properties of the other agent(s) accordingly. In some embodiments, a buffering capacity of the ion pairing agent(s) may be greater than a buffering capacity of the other agent(s). In some embodiments, the composition may not comprise flavoring or fragrance agents. In some embodiments, the composition may not comprise tobacco alkaloid compounds other than nicotine.

The choice of ion pairing agent (e.g., nature and amount) and desired target pH of a composition may be determined through systematic studies. For example, (1) a composition may be formulated from individual components or ingredients described above, including one or more ion pairing agents and nicotine; (2) the pH of the composition may be measured; (3) the composition may be vaporized to form a condensation aerosol, such that the fraction of nicotine in the gaseous phase versus the fraction of nicotine in the aerosol phase of the resulting condensation aerosol may be measured along with the pH of the collected aerosol; and (4) the composition may be tested on the respiratory tract of a mammal (e.g., a human, dog, rodent, or other mammal) and the deposition of nicotine may be measured directly or indirectly. For example, the deposition of nicotine may be measured via imaging and/or via pharmacokinetic studies, wherein a faster systemic absorption generally indicates deeper lung delivery, and a slower systemic absorption generally indicates more shallow delivery such as deposition in the oropharynx or upper respiratory tract. The composition then may be refined based on the data collected for the composition, and the testing process repeated so as to obtain optimal deep lung deposition, e.g., via proper partitioning of nicotine between the particle phase and gas phase of an aerosol. A certain amount of deep lung deposition may be achieved via off-gassing, even if other components of the aerosol are exhaled, as may occur in aerosols with mass median aerodynamic diameters less than about 1 μm.

Nicotine may be delivered in aerosol form, wherein the aerosol comprises particles with a mass median aerodynamic diameter less than about 4 μm, e.g., between about 200 nm and about 4 μm, such as from about 500 nm to about 1 μm. The term "mass median aerodynamic diameter" is generally understood to mean that 50% of the total particle mass is made from particles having a diameter larger than the mass median aerodynamic diameter, and 50% of the total particle mass is made from particles having a diameter less than the mass median aerodynamic diameter. In some embodiments, for example, the aerosol may comprise particles having a mass median aerodynamic diameter of about 200 nm, about 300 nm, about 350 nm, about 400 nm, about 450 nm, about 500 nm, about 550 nm, about 600 nm, about 750 nm, about 850 μm or about 1 μm. Aerosol particle sizes suitable for inhalation into the body, e.g., via the respiratory system, are discussed in U.S. Pat. No. 7,766,013, which is incorporated by reference herein.

The nicotine may be predominantly in the particulate phase of the aerosol, but may enter the gaseous phase at a rate sufficient to cause deposition of nicotine in the alveoli of the deep lung, e.g., via diffusion or off-gassing from aerosol particles that reach the deep lung. Such deposition via diffusion may be relatively less important for particles having a diameter between about 1 μm and about 4 μm, and relatively more important for particles having a diameter less than about 1 μm. The present disclosure may allow for balancing the fraction of nicotine in the gaseous phase versus the particulate phase of an aerosol, such that a sufficient fraction or amount of nicotine is in the particulate phase to effectively traverse the oropharynx and upper respiratory tract, yet there is sufficient exchange into the gaseous phase to allow for deposition of nicotine in the alveoli via off-gassing.

In some embodiments, at least 50% of the nicotine by weight with respect to the total weight of the composition may be in the particulate phase of the aerosol, such as greater than about 75%, greater than about 85%, greater than about 90%, or even greater than about 95%. In some embodiments, the amount of nicotine in the particulate phase of the aerosol by weight with respect to the total weight of the composition may range from about 50% to about 99.5%, such as from about 80% to about 98%, from about 83% to about 99%, from about 83% to about 95%, from about 84% to about 94%, from about 85% to about 97.5%, from about 88% to about 99%, from about 85% to about 95%, from about 88% to about 94%, from about 85% to about 90%, from about 87% to about 95%, or from about 86% to about 94%. In at least one embodiment, greater than about 90% of the nicotine by weight with respect to the total weight of the composition may be in the particulate phase of the aerosol.

Embodiments of the present disclosure may increase the amount of nicotine being absorbed into the circulatory system per unit time, e.g., increase the efficiency of nicotine uptake by the body. For example, one or more compositions disclosed herein may result in greater than about 25% (e.g., between about 25% and about 100%), greater than about 30%, greater than about 35%, greater than about 40%, greater than about 45%, greater than about 50%, greater than about 55%, greater than about 60%, greater than about 65%, greater than about 70%, greater than about 80%, or even greater than about 90%, of the nicotine being absorbed into circulation in less than 5 minutes from inhalation of the aerosol, such as less than 3 minutes, or less than 2 minutes from inhalation of the aerosol. In at least one embodiment, for example, the composition may result in about 70% to about 100%, such as from about 80% to about 95% of the nicotine being absorbed into circulation in less than 5 minutes. The fraction absorption of nicotine over particular period of time can be calculated based on pharmacokinetic data using methods generally known in the art. In some embodiments, for example, the absorption may result in the peak plasma level of nicotine in the blood being achieved shortly after completion of inhalation, e.g. within about 240 seconds, about 120 seconds, about 60 seconds, or even about 30 seconds.

The addition of at least one ion pairing agent, for example, may increase the efficiency and/or rate of nicotine uptake in comparison to a composition without the ion pairing agents. The increase in nicotine uptake provided by an electronic cigarette according to the present disclosure may improve a user's experience and/or increase the user's enjoyment of the electronic cigarette. Embodiments of the present disclosure may better satisfy the cravings of the user, thereby facilitation or leading to more effective cessation of combustion cigarette smoking Devices and Containers The present disclosure is not limited to any particular vaporization/vaping device or vaporization method. The compositions described herein generally may be used, for example, in any electronic cigarette, cigar, vaping device, or other vaporization device, including disposable and/or rechargeable devices, and commercially-available devices, as well as any suitable containers for compositions used for aerosol generation.

Various aspects of the present disclosure may be used with and/or include one or more of the features or configurations disclosed in U.S. application Ser. No. 13/729,396, filed Dec. 28, 2012, and issued as U.S. Pat. No. 8,539,959, entitled "Electronic Cigarette Configured to Simulate the Natural Burn of a Traditional Cigarette"; U.S. application Ser. No. 13/974,845, filed Aug. 23, 2013, and published as US 2013/0333712 A1, entitled "Electronic Cigarette Configured to Simulate the Natural Burn of a Traditional Cigarette"; U.S. application Ser. No. 13/627,715, filed Sep. 26, 2012, entitled "Electronic Cigarette Configured to Simulate the Natural Burn of a Traditional Cigarette"; U.S. application Ser. No. 13/741,109, filed Jan. 14, 2013, and published as US 2013/0284190 A1, entitled "Electronic Cigarette Having a Paper Label"; U.S. application Ser. No. 13/744,092, filed Jan. 17, 2013, and published as US 2013/0284191 A1, entitled "Electronic Cigarette Having a Flexible and Soft Configuration"; U.S. application Ser. No. 13/744,176, filed Jan. 17, 2013, entitled "Aroma Pack for an Electronic Cigarette"; U.S. application Ser. No. 13/744,812, filed Jan. 18, 2013, and published as US 2013/0276802 A1, entitled "Electronic Cigarette Configured to Simulate the Filter of a Traditional Cigarette"; U.S. application Ser. No. 13/490,352, filed Jun. 6, 2012, and published as US 2013/0140200 A1, entitled "Electronic Cigarette Container and Method Therefor"; U.S. application Ser. No. 13/707,378, filed Dec. 6, 2012, and issued as U.S. Pat. No. 8,596,460, entitled "Combination Box and Display Unit"; U.S. application Ser. No. 13/495,186, filed Jun. 13, 2012, and published as US 2013/0248385, entitled "Electronic Cigarette Container"; U.S. application Ser. No. 13/954,593, filed Jul. 30, 2013, and published as US 2013/0313139, entitled "Electronic Cigarette Container"; U.S. Provisional Application No. 61/891,626, filed Oct. 16, 2013, entitled "Portable Vaporizer Packaging"; U.S. application Ser. No. 14/274,396, filed May 9, 2014, entitled "Packaging for Vaporizing Device"; U.S. Provisional Application No. 61/918,480, filed Dec. 19, 2013, entitled "Vaporizing Device with Multicolor Light"; U.S. Provisional Application No. 61/906,795, filed Nov. 20, 2013, entitled "Electronic Cigarette Having Multiple Air Passages"; U.S. Provisional Application No. 61/906,803, filed Nov. 20, 2013, entitled "Leak Prevention Device for an Electronic Cigarette"; U.S. Provisional Application No. 61/906,810, filed Nov. 20, 2013, entitled "Packaging Assembly"; U.S. Provisional Application No. 61/907,002, filed Nov. 21, 2013, entitled "Electronic Cigarette and Method of Assembly Therefor"; U.S. Provisional Application No. 61/907,003, filed Nov. 21, 2013, entitled "Flexible and Stretchable Electronics for an Electronic Cigarette"; U.S. Provisional Application No. 61/847,364, filed Jul. 17, 2013, entitled "Wireless Communication System for an Electronic Cigarette"; U.S. Provisional Application No. 61/971,340, filed Mar. 27, 2014, entitled "Devices and Methods for Extending Battery Power"; U.S. Provisional Application No. 61/970,587, filed Mar. 26, 2014, entitled "Vaporizing Devices Comprising a Wick and Methods of Use Thereof"; U.S. Provisional Application No. 61/968,855, filed Mar. 21, 2014, entitled "Vaporizing Devices Comprising a Core and Methods of Use Thereof"; U.S. Provisional Application No. 61/938,451, filed Feb. 11, 2014, entitled "Electronic Cigarette with Carbonaceous Material"; U.S. Provisional Application No. 61/979,236, filed Apr. 14, 2014, entitled "Systems and Methods for Restricting Rotation"; and/or U.S. application Ser. No. 14/276,547, filed May 13, 2014, entitled "Mechanisms for Vaporizing Devices"; the disclosures of each of which are incorporated by reference herein.

Figure 1B:
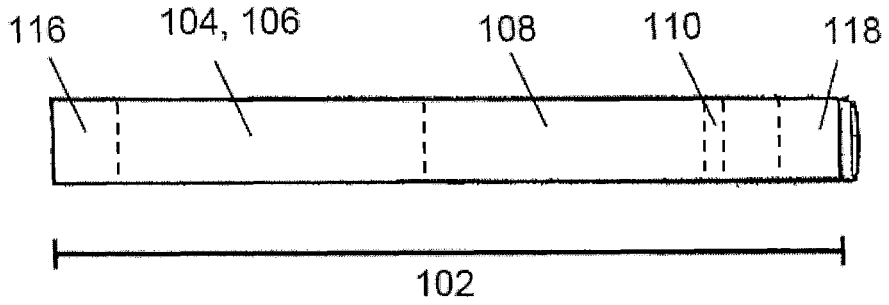
FIG. 1B shows the electronic cigarette of FIG. 1A assembled, in accordance with one or more embodiments of the present disclosure.

An exploded, partial cross-section view of an exemplary vaporizing device, electronic cigarette 100, useful in improved nicotine delivery according to the present disclosure is shown in FIG. 1A. The electronic cigarette 100 may comprise a housing 102 that completely covers all internal components of the electronic cigarette 100, as shown in FIG. 1B. While FIGS. 1A and 1B illustrate an exemplary combination of internal components, vaporizing devices according to the present disclosure need not include each and every component shown. The housing 102 may be flexible and/or resilient along at least a portion of the housing 102, e.g., the entire length of the housing 102. The housing 102 may be covered by a paper label, e.g., to simulate the appearance and/or feel of a traditional cigarette. In some embodiments, the housing 102 may comprise a two (or more) piece assembly. For example, the housing 102 may comprise two or more components configured to be disassembled for purposes of charging or replacing a battery and/or replacing a liquid-containing cartridge (see, e.g., FIG. 2, discussed below).

Figure 4:
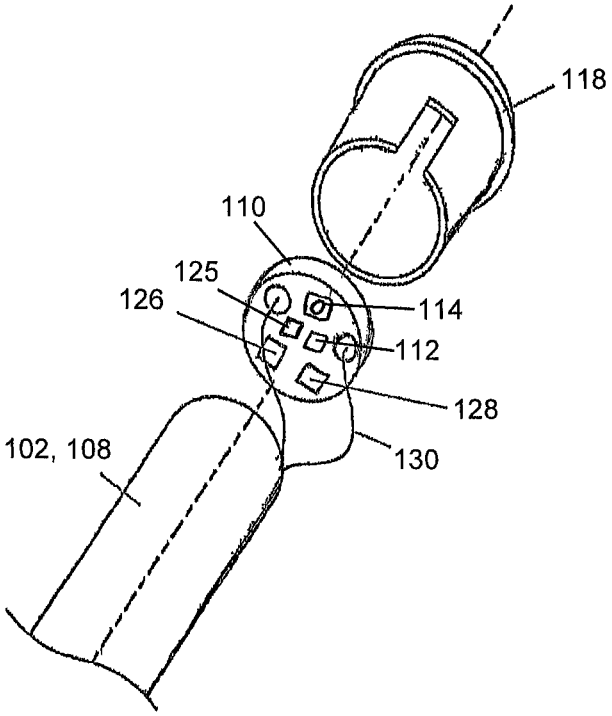
FIG. 4 shows a portion of an exemplary vaporizing device, in accordance with one or more embodiments of the present disclosure.

Referring to FIGS. 1 and 4, the internal components of the electronic cigarette 100 may include one or more of a reservoir 104, a heating element 106, a battery 108, an integrated circuit 110, a processor or microprocessor 125, memory 126, a transmitter 128, at least one sensor 112, and/or at least one light source 114, e.g., a light-emitting diode (LED). Any features with respect to a battery, operation of a battery, a microprocessor, and/or transmitting or recording information regarding power characteristics or inhalation characteristics as disclosed in U.S. Provisional Application No. 61/826,318, filed May 22, 2013; U.S. Provisional Application No. 61/856,374, filed Jul. 19, 2013; U.S. Provisional Application No. 61/971,340, filed Mar. 27, 2014, and/or U.S. Provisional Application No. 61/847,364, filed Jul. 17, 2013, each of which is incorporated by reference herein, may be used according to the present disclosure.

The electronic cigarette 100 may include a mouthpiece 116 insertable in a first end of the housing 100 and a tip portion 118 insertable in a second end of the housing 100. The outermost surface of the first end of the housing 100 (e.g., outside of the label) may include a coating to protect against moisture from the user's mouth. The tip portion may include at least one air inlet, e.g., a notch in the tip portion 118, and may be at least partially transparent to allow light to pass through to simulate the natural burn of a traditional cigarette. The mouthpiece 116 may include an outlet in communication with a conduit 120 through the reservoir 104, e.g., for inhaling a vaporized nicotine composition.

The reservoir 104 may comprise an absorbable material, e.g., cotton fiber or other fibrous matrix, that includes a liquid composition absorbed therein as described above. For example, the fiber may be saturated with a liquid comprising nicotine according to the present disclosure. The reservoir 104 may comprise part of an aerosol assembly that includes the heating element 110 coupled to a wick 122, for example, wherein the wick 122 may absorb or adsorb liquid from the fiber. Inhalation by a user at the outlet of the mouthpiece 116 may lower the pressure in the housing 100, wherein the negative pressure may be detected by the sensor 112. The sensor 112 may cause the heating element 110 to turn on, thus generating heat, and causing the liquid absorbed by the wick 122 to vaporize. The vaporized composition may be drawn through the conduit and condense into an aerosol, e.g., via spontaneous condensation, which exits the electronic cigarette 100 via the outlet in the mouthpiece 116 via the conduit 120, e.g., into the user's lungs. Any features with respect to aspects or components of a vaporizing unit. e.g., a reservoir, a wick, a heating element, and/or other components used for vaporization, as disclosed in U.S. Provisional Application No. 61/970,587, filed Mar. 26, 2014; U.S. Provisional Application No. 61/968,855, filed Mar. 21, 2014; U.S. Provisional Application No. 61/938,451, filed Feb. 11, 2014; U.S. Provisional Application No. 61/906,795, filed Nov. 20, 2013; U.S. Provisional Application No. 61/906,803, filed Nov. 20, 2013; and/or U.S. Provisional Application No. 61/907,002, filed Nov. 21, 2013, each of which is incorporated by reference herein, may be used according to the present disclosure. In some embodiments, for example, the electronic cigarette may include a filter section in addition to, or as an alternative to, the mouthpiece 116. The filter section may include a porous material such as a membrane, a fibrous matrix, or disc that allows vapor to pass therethrough to simulate the experience of inhaling through a traditional cigarette filter. Any of the features of a filter as disclosed in U.S. application Ser. No. 13/744,812, filed Jan. 18, 2013, and published as US 2013/0276802 A1, and/or U.S. Provisional Application No. 61/906,803, filed Nov. 20, 2013, each of which is incorporated by reference herein, may be used according to the present disclosure. For example, the filter section may include an acidic fiber. In some embodiments, the filter section may include one or more openings for passage of vapor in combination with, or as an alternative to, the porous material.

Figure 2:
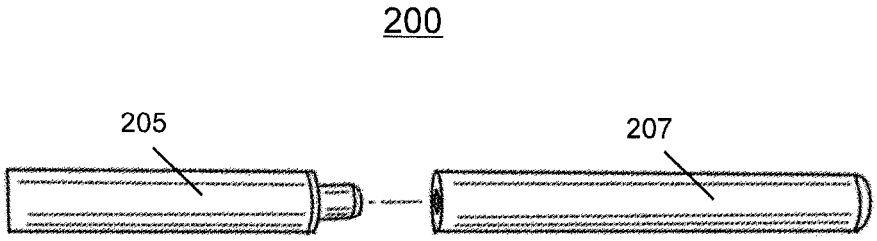
FIG. 2 shows an exemplary electronic cigarette, in accordance with one or more embodiments of the present disclosure.
Figure 3:
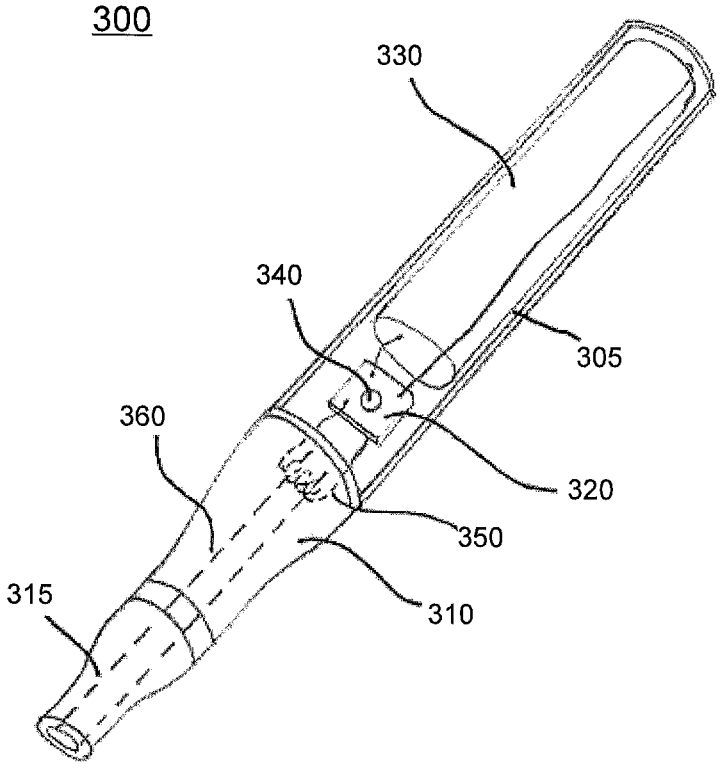
FIG. 3 shows an exemplary vaporizing device, in accordance with one or more embodiments of the present disclosure.

Other exemplary vaporizing devices that may use compositions as described herein for vapor and aerosol generation are shown in FIGS. 2 and 3, each of which may include any combination of the internal components of the electronic cigarette 100 discussed above. FIG. 2 shows an exemplary rechargeable electronic cigarette 200 comprising a cartridge unit 205 and a battery unit 207 that may be connected for use, e.g., via complementary threaded portions or other mating elements, and disconnected for replacement, recharging, or repair as needed. For example, the cartridge unit 205 may include a vaporization unit comprising one or more of a reservoir 104, a heating element 106, a wick 122, and/or a conduit 120; and the battery unit 207 may include one or more of a battery 108, an integrated circuit 110, sensor(s) 112, and/or light source(s) 114. In some embodiments, the battery unit 207 may include a rechargeable battery, and the cartridge unit 205 may include a refill valve or tank for receiving a liquid composition as described above. In some embodiments, the cartridge unit 205 may be configured for one-time use, such that once the liquid composition in a first cartridge unit has been depleted, a second, replacement cartridge unit may be connected to the battery unit 207 for use.

FIG. 3 shows an exemplary vaping device 300 comprising a base 305, a liquid tank 310, and a mouthpiece 315. The base 305 may house a battery 330, e.g., a rechargeable battery, operably coupled to a printed board circuit (PCB) assembly 320 and a heating element, e.g., heating wire 350. The tank 310 may include a composition as described above, e.g., to generate aerosols upon application of heat to the composition from the heating wire 350. In some embodiments, the vaping device 300 may include an actuator such as a power button 340 to initiate, control, and/or terminate heat supplied to the heating wire 350. Additionally or alternatively, the vaping device may include a sensor, such as the sensor 112 of electronic cigarette 100, for controlling the supply of heat upon detecting certain conditions or phenomena. An inner portion of the tank 310 may define an airway 360 extending through the mouthpiece 315 for generation of condensation aerosol, and passage of the aerosols to a user for inhalation. The tank 310 may be refillable, e.g., via a suitable refill valve or inlet, or replaceable to replenish the vaporing device 300 with the composition (or another composition having, e.g., different flavors and/or concentrations of nicotine), as needed.

Certain materials may affect the performance and/or stability of compositions used to generate aerosols. In addition to the various components of a vaporizing device or containers for housing device components of a vaporizing device, the materials used in manufacturing the device, materials in the device itself, and/or materials used in containers for housing or storing the composition used to generate the aerosol may impair the performance and/or stability of the composition. Certain metals or metal alloys, for example, may catalyze, accelerate, or otherwise promote degradation of various chemical compounds. Thus, devices, device components, and containers suitable for the present disclosure may include materials that do not catalyze the degradation of one or more components of the composition such as nicotine, ion pairing agent(s), carrier solvent(s), and/or other components.

For example, embodiments of the present disclosure include disposable and refillable devices such as liquid-loaded devices, cartomizers (e.g., for housing a liquid and configured to mate with, or otherwise compatible with, a power source such as a battery or battery unit for vaporizing the liquid), and bottles and other containers used for storage of a liquid (e.g., used to fill a separate vaporizing/vaping device). Those devices, bottles, and containers may comprise materials that do not promote degradation of the composition, and may not comprise materials that are detrimental to the performance and/or stability of the composition. For example, the present disclosure includes vaporizing devices, cartomizers, and containers that do not comprise quantities of metals sufficient to catalyze the degradation of nicotine and/or other components of the composition. Exemplary metals that are not in contact with the composition may include, but are not limited to, brass and copper. In some embodiments, the device(s) or various components of the device(s) may lack materials that act as catalysts to degrade nicotine and/or other components of the composition. In some embodiments, the device(s) or various components of the device(s) may be configured to prevent contact between the composition and any materials that may act as catalysts to degrade nicotine and/or other components of the composition.

Voltage Control

Embodiments of the present disclosure may allow for modulation of the voltage or current, e.g., from one inhalation to the next (puff to puff) and/or over the course of a single inhalation. The battery voltage may be modulated, for example, to vary the amount of heat generated by the heating element to control or otherwise affect aerosol generation and/or to optimize battery performance.

Embodiments of the present disclosure may allow for the dose of nicotine emitted to be modulated from puff to puff to meet the desires of a user, e.g., by varying the nicotine dose for certain puffs with respect to others, such as in a sequence of puffs. For example, a user may prefer to receive the greatest amount of nicotine in the first puff, e.g., to satisfy cravings after not having used the device for a period of time. Another user may prefer escalating doses of nicotine across a series of puffs, e.g., to satisfy cravings as the user becomes accustomed to the nicotine dose as receptor desensitization begins to occur. Yet another user may wish to receive a higher dose of nicotine in response to stronger puffs, similar to a traditional tobacco cigarette.

In some embodiments, an electronic cigarette or other vaporizing device may be configured to modulate the nicotine dose by controlling the passage of current to the heating element. For example, the electronic cigarette may include a programmable element such as a microprocessor configured to record the history (at least for a short time) of activation of the device through user puffing, and to modify the passage of current accordingly. In at least one embodiment, for example, the electronic cigarette may comprise a mouthpiece, an airway, a nicotine reservoir (e.g., a reservoir comprising a nicotine composition), a heating element, a battery, a breath sensor, and a microprocessor. The electronic cigarette may be programmed such that, when it has not been used (e.g., activated) for a fixed predetermined period of time (e.g., at least one minute, at least 2 minutes, at least 3 minutes, at least 5 minutes, at least 10 minutes, at least 15 minutes, at least 20 minutes, at least 30 minutes, at least 60 minutes, at least 120 minutes, or at least 240 minutes), the first use or actuation of the device may result in greater than normal passage of current to the heating element.

Because the composition may heat up over time with use of the device, later puffs may deliver a higher dose of nicotine than the initial puff. By increasing the passage of current for the first puff relative to subsequent puffs, the device may help to ensure a desired dose of nicotine. Depending on the extent to which the passage of current is initially increased, this may (1) ensure that the first dose is sufficient compared to subsequent doses; and/or (2) ensure that the first dose is sufficiently high, perhaps higher than subsequent doses, e.g., to satisfy the cravings of the user. In some embodiments, the passage of current may be increased within a range of 120% to 400%, such as 150%, 200%, 250%, 300%, or 350%. Augmentation of current may be attained, for example, by increasing the duration of passage of current from the battery to the heating element, and/or by increasing the voltage across the heating element. The emitted dose of nicotine (and/or other components of the composition) may be modified according to other needs or desires of a user by adjusting the passage of current accordingly.

As indicated above, a related factor that may impact the consistency of emitted dose may be the temperature of the composition and/or the temperature of the heating element prior to initiating of the passage of current to generate and deliver the aerosol. In some embodiments, the device may comprise a temperature measuring unit, such as a thermocouple or other thermometer. The temperature measuring unit may be in electrical contact with the microprocessor, so that the extent of passage of current to the heating element can be tailored to the temperature of the heating element and/or the composition prior to actuation of the device, e.g., via user inhalation. If the heating element and/or composition has a higher temperature prior to actuation, for example, less current may be required to generate the desired dose. If the heating element and/or composition has a lower temperature prior to actuation, for example, more current may be required to generate the desired dose.

Modulating the passage of current based on temperature may account for sequential heating of the composition during a series of puffs, which may result in escalating emission of nicotine aerosol. Additionally or alternatively, modulating the passage of current based on temperature may help to mitigate the potential for environmental temperature to impact the effectiveness of nicotine delivery from the device, wherein warmer conditions may favor adequate or excessive amounts of nicotine (and/or other composition components), and/or cooler conditions may lead to inadequate amounts of nicotine (and/or other composition components).

In some embodiments, the electronic cigarette may include a sensor, such as a breath sensor. The breath sensor may include a switch. In some embodiments, the electronic cigarette may include a sensor configured to measure the extent of user inhalation (e.g., duration, pressure drop, frequency, or extent of airflow resulting from inhalation), and to transmit such information to the microprocessor. Thus, the microprocessor may modulate the extent of heating of the composition, wherein a greater extent of inhalation may be associated with a greater degree of heating.

The present disclosure includes a device for the delivery of a condensation aerosol comprising nicotine, the device comprising a breath sensor, a mouthpiece, an airway, a reservoir comprising a composition comprising nicotine, a heating element, a battery to power said heating element, and a microprocessor, wherein the microprocessor records the history of activation of the breath sensor and adjusts the extent of passage of electric current from the battery to the heating element in response to said history. Embodiments of the present disclosure may include one or more of the following features: the microprocessor may trigger passage of current from the battery to the heating element upon activation of the breath sensor; the microprocessor may send a signal that increases the duration of current passage from the battery to the heating element when the breath sensor had not been previously activated in a preceding predetermined interval of time; the predetermined interval of time may be greater than 5 minutes and less than 2 hours; the predetermined interval of time may be greater than 8 minutes and less than 30 minutes; the extent of increase of the duration of current passage may be between 120% and 250%; the microprocessor may send a signal that decreases the duration of current passage from the battery to the heating element when the breath sensor had been previously activated in a preceding predetermined interval of time; the microprocessor may send a signal that decreases the duration of current passage from the battery to the heating element when the breath sensor had been previously activated more than once in a preceding predetermined interval of time; the period of time may be between 15 seconds and 30 minutes; the period of time may be between 30 seconds and 2 minutes; the microprocessor may adjust the voltage across the heating element; the device may comprise a temperature sensor; and/or the extent of passage of current from the battery to the heating element may be modulated in response to the temperature of the heating element or composition comprising nicotine as measured prior to actuation of the device, wherein the passage of current may be decreased if the prior temperature increases, or vice versa.

The present disclosure further includes a method of increasing the reproducibility of nicotine condensation aerosol delivery from electronic cigarette, the method comprising: modulating the extent of heating of a composition comprising nicotine based on either the immediate prior extent of usage of the device or the temperature of the nicotine containing composition or the heating element.

As mentioned above, embodiments of the present disclosure may allow current to be modulated within a single inhale. Referring to FIG. 4, for example, the battery 108 of a vaporizing device may supply power to the heating element 106 for heating and vaporizing a composition (e.g., as described herein) for aerosol generation and/or for supplying power to the integrated circuit 110. The battery 108 may include any of the features of a battery disclosed in U.S. application Ser. No. 13/729,396, filed Dec. 28, 2012, now U.S. Pat. No. 8,539,959; U.S. Provisional Application No. 61/906,803, filed Nov. 20, 2013; U.S. Provisional Application No. 61/907,002, filed Nov. 21, 2013; and/or U.S. Provisional Application No. 61/907,003, filed Nov. 21, 2013; each of which is incorporated by reference herein. The battery 108 may be coupled to the integrated circuit 110, e.g., via wires 130 for supplying power to the integrated circuit 110. In some embodiments, the battery 108 may be immovable and inseparable from other components of the vaporizing device, e.g., configured for use in a single electronic cigarette 100 to be discarded along with the used cigarette 100. In some embodiments, the battery 108 may be rechargeable, e.g., via a suitable electronic connection while the battery 108 is contained within the housing 102 (such as housed within a battery unit 207 of a rechargeable electronic cigarette 200 as discussed above and shown in FIG. 2) and/or upon removal of the battery 108 from the housing 102. Exemplary batteries 108 suitable for the present disclosure include lithium ion batteries. In at least one embodiment, the battery 108 may have a maximum voltage of about 4.2 V and a nominal voltage of about 3.6 V, such as a lithium ion battery. Any other suitable battery 108 may be used according to the present disclosure, however.

The integrated circuit(s) 110 may be configured to control and/or receive information from one or more electronic components of the vaporizing device, such as, e.g., the sensor(s) 112, the light source(s) 114, the memory 126, and/or the transmitter(s) 128. The integrated circuit 110 may include any of the features disclosed in U.S. application Ser. No. 13/729,396, filed Dec. 28, 2012, now U.S. Pat. No. 8,539,959; U.S. Provisional Application No. 61/918,480, filed Dec. 19, 2013; U.S. Provisional Application No. 61/906,795, filed Nov. 20, 2013; U.S. Provisional Application No. 61/907,003, filed Nov. 21, 2013; and/or U.S. Provisional Application No. 61/847,364, filed Jul. 17, 2013; each of which is incorporated by reference herein. Suitable types of integrated circuits 110 according to the present disclosure may include, but are not limited to, analog, digital, and mixed signal integrated circuits, application-specific integrated circuits (ASICs), and microprocessors. In some embodiments, one or more sensor(s) 112 and/or one or more light source(s) 114 may be directly coupled to the integrated circuit 110, as shown in FIG. 4, or may otherwise be operably coupled to the integrated circuit 110 to transmit and receive information. The light source(s) 114 and/or sensor(s) 112 may include any of the features disclosed in U.S. application Ser. No. 13/729,396, filed Dec. 28, 2012, and issued as U.S. Pat. No. 8,539,959; U.S. application Ser. No. 13/627,715, filed Sep. 26, 2012; U.S. application Ser. No. 13/974,845, filed Aug. 23, 2013, and published as US 2013/0333712 A1; and/or U.S. Provisional Application No. 61/918,480, filed Dec. 19, 2013. Examples of sensors 112 suitable for the present disclosure include pressure sensors, accelerometers or other motion sensors, flow rate sensors, heat sensors, moisture sensors, temperature sensors, electrical current and/or resistance sensors, and other devices and components for detecting various environmental, chemical, or biological conditions or phenomena. In addition or alternatively, the integrated circuit 110 may include the microprocessor 125, the memory 126, and/or one or more transmitters 128, e.g., directly coupled to the integrated circuit 110, as shown in FIG. 4, or otherwise operably coupled to the integrated circuit 110. The integrated circuit 110, the sensor(s) 112, the light source(s) 114, the microprocessor 125, the memory 126, and/or the transmitter(s) 128 may be coupled via a printed circuit board. The shaft of the tip portion 118 may have an inside diameter larger than the outside diameter of the integrated circuit 110 so that the integrated circuit 110 may be held securely within the shaft.

Upon inhalation of the vaporizing device, for example, a pressure sensor 112 may detect a pressure level and/or change in pressure within the vaporizing device (e.g., electronic cigarette 100 or 200, or vaping device 300), which may in turn control one or more other components of the vaporizing device. For example, information from the pressure sensor 112 may trigger control of the battery 108 and/or light source(s) 114 through the integrated circuit 110. A change in pressure detected within the vaporizing device may prompt the battery 108 to supply power to the heating element, thus heating a liquid composition within the vaporizing device to produce a vapor. In some embodiments, the vaporizing device may include more than one pressure sensor 112, or a combination of different sensors, e.g., including a pressure sensor 112 and one or more other sensors. The pressure sensor 112 and/or any other sensor 112 may include any of the features disclosed in U.S. application Ser. No. 13/729,396, filed Dec. 28, 2012, now U.S. Pat. No. 8,539,959 and/or U.S. Provisional Application No. 61/918,480, filed Dec. 19, 2013, each of which is incorporated by reference herein.

The microprocessor 125 may include any suitable microprocessor, e.g., a programmable microprocessor. The microprocessor 125 may use an algorithm, such as a computer algorithm executed via a software program, to monitor and/or store data related to the use and/or the status of the vaporizing device. In some embodiments, the microprocessor 125 may be coupled to one or more sensor(s) 112, e.g., for monitoring use of the vaporizing device (or characteristics of the user) and/or the status of various components of the vaporizing device.

For example, the microprocessor 125 may be configured to monitor and/or store data regarding the number of times a user inhales the vaporizing device, the strength of inhale (e.g., pressure within the electronic cigarette 100 or 200, or the vaping device 300), the time and date of the inhale, the frequency of inhale, the duration of inhale, and/or the concentration of nicotine in the aerosol (e.g., concentration of nicotine in the particle and/or gas phases of the aerosol) per inhale and/or per use of the vaporizing device. Alternatively or additionally, the microprocessor 125 may be configured to monitor and/or store data regarding the operating status of one or more components of the vaporizing device such as, e.g., the battery 108, a vaporization unit (including, e.g., the heating element 106, presence or absence of liquid, temperature, etc.), the light source(s) 114, and/or the sensor(s) 112 (e.g., pressure, motion, electrical current, temperature, and/or resistance sensors). The data regarding use of the vaporizing device (or characteristics of the user) and/or the status of various components of the vaporizing device may be stored by the microprocessor 125 and/or the memory 126. The memory 126 may include any suitable type of memory for receiving and storing data, including non-volatile types of memory such as flash memory.

The recorded data may be downloadable, e.g., to allow analysis of the data via an electronic device (e.g., a desktop computer, laptop computer, smart phone, smart watch, tablet computer, etc.). For example, the vaporizing device may be disassembled so that the microprocessor 125 and/or the memory 126 may be removed and the data manually downloaded. In some embodiments, the vaporizing device may include an input/output port, e.g., coupled to the integrated circuit 110, for connecting the microprocessor 125 and/or memory 126 to an electronic device for downloading. In some embodiments, data may be wirelessly transmitted to an electronic device, e.g., as discussed in U.S. Provisional Application No. 61/847,364, filed Jul. 17, 2013, which is incorporated by reference herein. For example, one or more transmitters 128 may be coupled to the microprocessor 125 and/or the memory 126. The microprocessor 125 may be configured to instruct the transmitter 128 to wirelessly transmit data stored on the microprocessor 125 and/or the memory 126 to an electronic device on demand and/or at predefined intervals. In some embodiments, the transmitter 128 may transmit data upon initiation of application software on the electronic device as long as a connection remains established between the transmitter 128 and the electronic device. The transmitter 128 may operate via Bluetooth technology, or any other suitable wireless technology to transmit the data.

In at least one embodiment, the microprocessor 125 may be used to monitor usage and/or the lifetime of the battery 108. For example, the microprocessor 125 may receive information regarding the current status and/or operating condition of the battery 108 (such as, e.g., the voltage, current, and/or resistance of the battery 108), may store data regarding past usage of the battery 108, and/or may predict or estimate the operating status of the battery 108 at a future time based on past and/or current usage of the battery 108.

The vaporizing device may be configured to optimize the lifetime and/or performance of the battery 108. In some embodiments, for example, the integrated circuit 110 may be configured to minimize power consumption, e.g., to extend the life of the battery 108, while maintaining sufficient voltage to ensure adequate and consistent vaporization. In the case of a rechargeable battery, the integrated circuit 110 may be configured to maximize the lifetime and/or performance of the battery 108 before the need to recharge. In the case of a non-rechargeable or disposable battery, the integrated circuit 110 may be configured to maximize the lifetime and/or performance of the battery 108 prior to disposal of the vaporizing device (e.g., electronic cigarette 100) and/or recycling the battery 108 for re-use in the vaporizing device (e.g., electronic cigarette 200). For example, the integrated circuit 110 (e.g., an ASIC or other programmable circuit) may control the battery 108 in an energy-efficient manner, such as via pulse width modulation (PWM). Modulating the duty cycle of the battery 108 may allow the battery 108 to maintain a constant or near-constant voltage and current while accounting for a gradual decline in performance of the battery 108 over time. For example, a new, unused battery 108 may provide from about 4V to about 5V, e.g., about 4.25V, about 4.50V, or about 4.75V, but the voltage may decline with use over time to provide less than about 4V, such as less than about 3.75V, less than about 3.5V, less than about 3.25V, less than about 3V, or in some cases even less than about 2V. Lower voltage and current may lead to inadequate heating of the vaporization unit (e.g., via heating element 106), less efficient vaporization, and ultimately, a poor user experience. PWM may allow the battery 108 to provide a steady voltage and current, despite varying power capacity of the battery 108, and in turn, consistent heating of the vaporization unit to provide the user with consistent experience from puff to puff, such as a consistent level of nicotine from puff to puff. In some embodiments, the integrated circuit 110 may be configured to maximize or otherwise extend the total number of puffs of the vaporizing device, i.e., the total number of times a user may inhale the vaporizing device.

The vaporizing device may be configured to vaporize effectively a vaporization substance (e.g., a liquid and/or solid composition to be vaporized, such as the compositions described herein) without excessive thermal decomposition of the substance. To this end, the effective voltage and resistance of the vaporizing device may be chosen so as to generate a desired quantity of vaporization, e.g., a desired amount of the substance in aerosol form (e.g., 0.25 mg, 0.5 mg, 0.75 mg, 1 mg, 2 mg, 3 mg, 4, 5 mg, 7 mg, 10 mg, 15 mg, 20 mg, 30 mg, or 50 mg) per unit time (e.g., 0.25 seconds, 0.5 seconds, 0.7 seconds, 1 second, 2 seconds, 3 seconds, or 4 seconds). The effective voltage and resistance of the vaporizing device may further be chosen so as to generate a desired quantity of vaporization without excessive thermal degradation.

This may be achieved, for example, by having the integrated circuit 110 direct the battery 108 to pass sufficient current through the heating element 106 for an initial amount of time to effectively initiate rapid vaporization, and thereafter direct the battery 108 to pass a lesser current through the heating element 106 so as to avoid overheating of the heating element 106 or vaporization substance and associated thermal degradation. Thermal degradation may be of particular concern in electronic cigarettes or vaping devices when vaporizing thermally-labile flavoring agents or active substances, and/or when the liquid composition comprises nicotine and an ion-pairing agent, which may act to decrease the vapor pressure of the nicotine and/or may itself by thermally labile.

One thermal degradation product within the emitted aerosol of some electronic cigarettes and vaping devices is formaldehyde, which can be carcinogenic. A related aldehyde that may be disadvantageously produced during vaporization is acetaldehyde. Increased heating may result in increased production of formaldehyde, acetaldehyde, and/or other degradation products. Employing PWM in an operating mode of the battery 108 to control the amount of heat provided by the heating element 106 may result in decreased production of degradation products like formaldehyde or acetaldehyde. For example, the operation mode of battery 108 employing PWM for at least a portion of the time may produce less than about 0.1%, less than about 0.05%, less than about 0.02%, less than about 0.01%, or less than about 0.005% formaldehyde and/or acetaldehyde by weight in the emitted aerosol. In some embodiments, the vaporizing device may generate an aerosol comprising nicotine, wherein the ratio of nicotine to formaldehyde and/or the ratio of nicotine to acetaldehyde (by weight) is greater than about 100, greater than about 200, greater than about 400, greater than about 800, greater than about 1000, greater than about 1500, and/or greater than about 2000. To select the appropriate operation mode of the battery 108, the vaporizing device may be tested via a laboratory smoking machine. For example, the vaporizing device may be used to simulate smoking, wherein the aerosol emitted by the vaporizing device may be collected and the amount of formaldehyde and/or acetaldehyde in the emitted aerosol measured by a suitable method (e.g., by HPLC-UV). The operation mode of the battery 108 (or program employed by the integrated circuit 110 to control the battery 108) may be adjusted appropriately to ensure that the production of formaldehyde, acetaldehyde, and/or other degradation products does not exceed a threshold value, such as any of the upper limits listed above.

The integrated circuit 110 may direct the battery 108 (e.g., via microprocessor 125 and/or transmitter 128) to run at a particular duty cycle, e.g., to maintain an effective voltage. The term "effective voltage" as used herein refers to the voltage that if applied steadily to a circuit for an interval of time, would result in a total delivered energy equal to that delivered by the voltage (which may or may not be steady) applied to the circuit for that same interval of time. For example, a steady voltage of 4V produces an effective voltage of 4V, a voltage modulated rapidly in equal duration intervals (e.g., intervals of 0.0025 seconds each) between 4V and 0V produces an effective voltage of 2.82 V, and a voltage modulated rapidly in equal duration intervals (e.g., intervals of 0.0025 seconds each) between 4V and 2V produces an effective voltage of 3.16 V.

In some embodiments, the battery 108 may operate with a duty cycle within a range of about 5% to about 95% or within a range of about 45% to about 65%, such as about 10%, about 25%, about 50%, about 75%, or about 90%. Thus, the battery 108 may operate via PWM at an effective voltage that is less than its full voltage. In some embodiments, for example, the battery 108 may operate with PWM by switching or surging from full power to a percentage of full power, e.g., about 25% power, about 50% power, or about 75% power. In at least one embodiment, the battery 108 may surge from full power to half power at a particular frequency, e.g., 200 Hz. Further, the integrated circuit 110 may control the PWM switching frequency such as a frequency of about 100 Hz, about 150 Hz, about 200 Hz, about 250 Hz, or about 300 Hz. In at least one embodiment, the battery 108 may operate with PWM at a frequency of about 200 Hz.

The integrated circuit 110 may be programmed to control the battery 108 to maintain a constant or near-constant voltage over time. In at least one embodiment, the battery 108 may operate at a duty cycle to maintain a voltage of about 2.8 V, 3.0 V, 3.2 V, 3.4 V, 3.6V, 3.8V, 4.0V, 4.2V, 4.6V, or higher than 4.6V. The microprocessor 125 may periodically receive and/or request information regarding the usage and/or remaining life of the battery 108 as described above, and adjust the duty cycle and/or PWM frequency of the battery 108 accordingly to maintain the desired voltage and current. In some embodiments, for example, the microprocessor 125 may apply an algorithm to determine a set of operating parameters for the battery 108 in order for the battery 108 to maintain the desired voltage and current. The microprocessor 125 and/or memory 126 may include locally stored data, such as tabulated reference data, indicating a relationship among different operating parameters of the battery 108 (and/or other components within the vaporizing device) to provide a target voltage or current of the battery 108. Alternatively or additionally, the microprocessor 125 may access data remotely, e.g., stored in a database, such as via transmitter 128 or a sensor 112 in communication with the database, to determine suitable operating parameters for the battery 108.

Vaporization may occur at different rates during use of the vaporizing device, e.g., over the course of a single inhale, and/or during a prior inhale as compared to a subsequent inhale. That is, the current or voltage required for vaporization to generate aerosols for inhalation may vary over time during use of the vaporizing device. For example, the voltage or current required to generate an amount of aerosols during the first portion of an inhale, or the first inhalation in a sequence inhalations, may be different (i.e., greater or less) than the voltage or current required to generate the same amount of aerosols during a second or subsequent portion of the same inhale. Moreover, the voltage required to rapidly initiate aerosol generation during the first portion of an inhalation or the first inhalation in a sequence of inhalations, may if continued without modulation result in excessive heating and thus excessive aerosol generation, thermal degradation, burn risk, user discomfort, or battery consumption during the subsequent inhalations or portion thereof. Thus, the battery 108 may operate in two or more different modes over time.

In some embodiments, for example, the battery 108 may operate with PWM for only a portion of the time. In other embodiments, for example, the battery 108 may operate with PWM the entire time, but the effective voltage produced by the PWM may vary depending on the time interval. For example, the battery 108 may provide a steady (i.e., non-modulated) voltage for a first period of time (e.g., a first mode), and then operate with PWM for a second period of time (e.g., a second mode). Or, for example, the battery 108 may operate with PWM in a first mode, and then provide a non-modulated voltage in a second mode. The duration of the non-modulated mode may be selected to deliver a fixed amount of energy (E), even as battery voltage changes. Power (P) may be determined from voltage (V) and resistance (R) according to $P=V^2/R$, and the amount of energy delivered may be determined by $E=P\times t$, where t is time. Thus, for a fixed resistance (which in a vaporizing device such as an electronic cigarette or a vaping device may be determined by the physical properties of the heating element or heating wire), a time of 300 ms at V=3.8V would be expected to deliver approximately equivalent energy to a time of 423 ms at V=3.2V. Therefore, as battery voltage decreases, the integrated circuit 110 may be configured to increase the duration of a first non-modulated mode, so as to render the total energy delivered by that mode invariant with declining battery voltage, which may occur as a result of product usage or aging.

Alternatively, it may be desirable to increase the total energy delivered by the first non-modulated mode so that the total energy delivered during the duration of that mode equals the total energy delivered, under initial conditions when the battery 108 is fresh, during that same duration in time (e.g., $E_{first\ mode\ in\ used\ or\ aged\ battery}=E_{first\ mode\ in\ fresh\ battery}+P_{second\ mode}\times\Delta t$, where $\Delta t$ is the increase in duration of the first mode in the used or aged battery relative to the fresh battery). The total amount of energy to be delivered in the first mode may depend on the application or intended use of the vaporizing device, and the device design. In some embodiments, this total amount of energy may be selected so as to raise the temperature of the substance to be vaporized (e.g., a composition as described herein, also known as an e-liquid) to its vaporization temperature. In some embodiments, the total amount of energy delivered in the first mode may be between a lower bound of about 0.5 J, about 1 J, about 2 J, about 3 J, about 4 J, about 5 J, about 7 J, or about 10 J, and an upper bound of about 2 J, about 4 J, about 5 J, about 8 J, about 12 J, about 20 J, or about 40 J, e.g., ranging from about 0.5 J to about 40 J, from about 1 J to about 20 J, from about 5 J to about 12 J, or from about 7 J to about 10 J.

In some embodiments, the effective voltage or the total amount of energy delivered in one or more operation modes may be controlled by the integrated circuit in a manner that varies in response to the prior history of usage of the device. For example, in some embodiments, the duration of operation in a higher-voltage first activation mode (and/or the effective voltage in that mode) may be greater when the device has not been used for a fixed predetermined period of time, e.g., at least 1 minute, at least 2 minutes, at least 3 minutes, at least 5 minutes, at least 10 minutes, at least 15 minutes, at least 20 minutes 20, or at least 30 minutes. A beneficial result of this mode of control may be to ensure that the first nicotine dose in a series of doses is sufficient compared subsequent doses, which may tend to be greater because the nicotine composition has been preheated by the first actuation event. Another beneficial result of this mode of control may be to guard against overheating of the device if it is repeatedly activated within a brief window of time.

A key determinant of power output in a vaporization device may be the resistance of the heating element 106, e.g., a heating wire. In some embodiments of the present disclosure, the resistance of the heating element 106 may range from about 1.8 ohms to about 3.6 ohms, from about 2 ohms to about 3.2 ohms, from about 2 ohms to about 3 ohms, from about 2 ohms to about 2.8 ohms, from about 2.2 ohms to about 2.8 ohms, or from about 1.8 ohms to about 2.4 ohms. When applying PWM to reduce the effective (e.g., average) voltage of the battery 108, it may be desirable to decrease the resistance of the heating element 106. In some embodiments, the effective voltage of the battery 108 during one or more operation modes may be reduced to less than about 3.8 V, less than about 3.6 V, less than about 3.4 V, less than about 3.2 V, less than about 3, 2.8 V, less than about 2.6 V, or less than about 2.4 V, and the resistance of the heating element 106 may range from about 1.6 ohms to about 3.0 ohms, from about 1.6 ohms to about 2.8 ohms, from about 1.6 ohms to about 2.4 ohms, from about 1.8 ohms to about 2.6 ohms, from about 2.0 ohms to about 2.8 ohms, from about 2.2 ohms to about 2.8 ohms, or from about 2.0 ohms to about 2.6 ohms. In some embodiments, the effective voltage of the battery 108 during one or more operation modes may range from about 3.4 V to about 3.8 V, and the resistance of the heating element 106 may range from about 2.2 ohms to about 3.0 ohms. In some embodiments, the effective voltage of the battery 108 during one or more operation modes may range from about 3.0 V to about 3.4 V, and the resistance of the heating element 106 may range from about 1.6 ohms to about 2.4 ohms or from about 2.4 ohms to about 3.0 ohms. In some embodiments, the effective voltage of the battery 108 during one or more operation modes may range from about 2.6 ohms to about 3.0 ohms, and the resistance of the heating element 106 may range from about 1.6 ohms to about 2.4 ohms or from about 2.4 ohms to about 3.0 ohms.

Table 1 lists further examples of appropriate pairings of effective voltages and resistances for vaporization device activation, marked with an "X." Those pairings that may be suited to a first, time-restricted Mode 1 (e.g., not to exceed about 0.4 seconds, about 0.6 seconds, about 0.8 seconds, about 1 second, or about 1.2 seconds) are marked with a "1," and those pairings that may be suited to a second Mode 2 following a higher power Mode 1 are marked with a "2."

TABLE 1

Exemplary Voltage and Resistance Pairings

| Effective | Resistance (ohm) | | | | | | | | | | | |
|---|---|---|---|---|---|---|---|---|---|---|---|---|
| Voltage (V) | 1.8 | 2 | 2.2 | 2.4 | 2.6 | 2.8 | 3 | 3.2 | 3.4 | 3.6 | 3.8 | 4.0 |
| 4.6 | 1 | 1 | 1 | 1 | 1 | 1 | 1 | 1 | X | X | X | X |
| 4.4 | 1 | 1 | 1 | 1 | 1 | 1 | X | X | X | X | X | X |
| 4.2 | 1 | 1 | 1 | 1 | 1 | X | X | X | X | X | X | X |
| 4 | 1 | 1 | 1 | 1 | X | X | X | X | X | X | 2 | 2 |
| 3.8 | 1 | 1 | 1 | X | X | X | X | X | 2 | 2 | 2 | 2 |
| 3.6 | 1 | X | X | X | X | X | X | 2 | 2 | 2 | 2 | |
| 3.4 | X | X | X | X | X | 2 | 2 | 2 | 2 | 2 | | |
| 3.2 | X | X | X | 2 | 2 | 2 | 2 | 2 | 2 | | | |
| 3 | X | 2 | 2 | 2 | 2 | 2 | 2 | | | | | |

In some embodiments, the battery 108 may operate in three or more different modes, e.g., with different combinations of PWM modes (having the same or a different duty cycle with respect to another PWM mode) and/or non-modulated voltage modes (having the same or a different voltage with respect to another mode).

Figure 5:
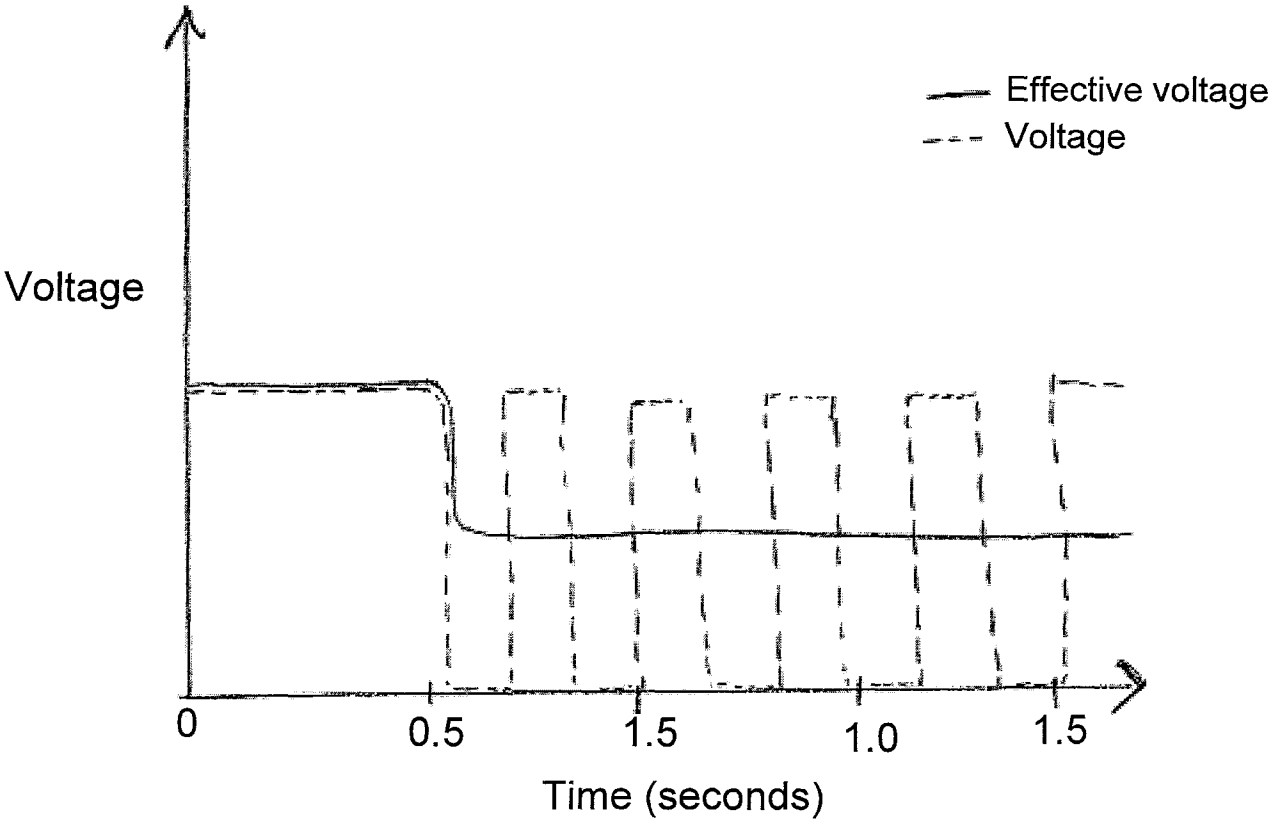
FIG. 5 shows an exemplary graph of battery voltage over time, in accordance with one or more embodiments of the present disclosure.

The period of time the battery 108 operates in each mode may range from about 0.01 seconds to about 30 seconds. For example, the battery 108 may operate in a given mode for about 0.05 seconds, about 0.1 seconds, about 0.15 seconds, about 0.2 seconds, about 0.25 seconds, about 0.3 seconds, about 0.35 seconds, about 0.4 seconds, about 0.45 seconds, about 0.5 seconds, about 0.55 seconds, about 0.6 seconds, about 0.65 seconds, about 0.7 seconds, about 0.75 seconds, about 0.8 seconds, about 0.85 seconds, about 0.9 seconds, about 0.95 seconds, about 1 second, about 1.25 seconds, about 1.5 seconds, about 1.75 seconds, about 2 seconds, about 2.25 seconds, about 2.5 seconds, about 2.75 seconds, about 3 seconds, about 3.25 seconds, about 3.5 seconds, about 3.75 seconds, about 4 seconds, about 4.25 seconds, about 4.5 seconds, about 4.75 seconds, about 5 seconds, about 10 seconds, about 15 seconds, about 20 seconds, about 25 seconds, or about 30 seconds. Shorter times (i.e., less than about 0.01 seconds) and longer times (i.e., greater than about 30 seconds) also may be suitable for embodiments of the present disclosure. In some embodiments, the integrated circuit 110 may control the battery 108 so as to operate in one mode for one or more inhalations. In at least one embodiment, the battery 108 may provide a maximum voltage immediately or promptly upon inhale by a user (e.g., for the first 0.3 seconds of use detected by the sensor 112), and then operate with PWM at a reduced voltage for the remainder of the inhale (e.g., the following 2 seconds or the remaining time of the inhale detected by the sensor 112). FIG. 5 shows an exemplary graph of voltage over the duration of a puff or inhale of a vaporizing device, e.g., electronic cigarette 100 or 200, wherein the battery 108 provides a maximum voltage for the initial 0.5 seconds of the puff, and then operates with PWM at a lower effective voltage for the remaining 1.5 seconds of the puff.

The amount of time that the battery 108 operates in a given mode may be adjusted over time, for example based on the status, operating condition, and/or age (or remaining life) of the battery 108. For example, the microprocessor 125 may receive and/or request data regarding the status of the battery 108 (e.g., directly from the battery 108, or via a sensor 112 or memory 126), and upon receiving data of a reduced power level of the battery 108, the microprocessor 125 may adjust the duration of time operating at full voltage, the duration of time operating with PWM, and/or the duty cycle when operating with PWM. In some embodiments, the operating mode(s) of the battery 108 may be adjusted to provide the same rate of vaporization, total amount of vapor, aerosol concentration, and/or concentration of nicotine in the aerosols from puff to puff. Thus, the integrated circuit 110 may control the battery 108 such that the battery 108 may operate according to different protocols over time. In a first protocol, the battery 108 may provide a maximum voltage for about the first 0.1, 0.2, 0.3, 0.4, 0.5, 0.6, 0.7, 0.8, 0.9, 1, or 1.5 seconds of use, and then operate with PWM at a lower voltage for the following time interval until user-induced actuation of the device terminates (e.g., inhalations stop in a breath-activated device or pushing of a button stops in a button-activated device). In a second or subsequent protocol, the battery 108 may provide a maximum voltage for the first 0.35 seconds of use followed by PWM at a lower voltage; in a third or subsequent protocol, the battery 108 may provide a maximum voltage for the first 0.4 seconds of use followed by PWM at a lower voltage; in a fourth or subsequent protocol, the battery 108 may provide a maximum voltage for the first 0.45 seconds of use followed by PWM; and in a fifth or subsequent protocol, the battery 108 may provide a maximum voltage for the first 0.5 seconds of use followed by PWM, etc.

In some embodiments, the amount of time the battery 108 operates in a particular mode may be determined by the microprocessor 125. For example, the microprocessor 125 may determine the length of time the battery 108 operates in a first mode (e.g., at a non-modulated voltage such as full power) from data stored in memory 126, such as a look-up table among different variables. For example, the stored data may include information regarding the type of battery 108, the amount and/or type of use of the battery 108, current, voltage, resistance, the number of previous puffs on the vaporizing device, temperature of the heating element/wire or e-liquid or environment, and/or the total duration of puffs on the vaporizing device, among other variables. As battery power decreases over the life of the battery 108, the amount of time that the battery 108 operates in a particular mode may be extended. For example, the microprocessor 125 may determine that the battery 108 should operate in the first mode (e.g., at a non-modulated voltage) for longer intervals over the life of the battery 108 to maintain a consistent experience over the life of the vaporizing device, e.g., based on stored data regarding characteristics of the battery 108. The amount of time in the first mode may provide an initial surge of energy to provide an amount of vaporization consistent with previous puffs, when the vaporizing device was operating with greater battery power, e.g., higher current and/or voltage.

One or more protocols may be used to optimize user experience, e.g., by generating a consistent amount or rate of vaporization, for example to provide a consistent level of nicotine from puff to puff. The integrated circuit may be pre-programmed with one or more protocols, and/or may be programmable, e.g., via a suitable wired or wireless connection with a software program.

While the foregoing discussion relates to electronic cigarettes, any of the features disclosed herein may comprise part of any other type of vaporizing device or inhalation device such as, e.g., electronic cigars, pipes, hookahs, nasal sprays, humidifiers, condensation aerosol devices for pharmaceutical drug delivery, and the like.

EXAMPLES

The following examples are intended to illustrate the present disclosure without, however, being limiting in nature. It is understood that the present disclosure encompasses additional embodiments consistent with the foregoing description and following examples.

Example 1

Gas/Particle Partitioning

Compositions ("LC0", "LC2", and "LC3") were prepared according to Table 2 by combining glycerol (≥99.5% w/w, Aldrich), propylene glycol (≥99.5%, Aldrich), nicotine (≥99%, Aldrich), and a flavor mixture. DL-lactic acid (USP, Fisher) was added to compositions LC2 and LC3 as ion pairing agent. The pH of each composition was measured with a standard electrochemical pH meter calibrated for accuracy in the pH range from 6-10. The observed pH ranged from 9.6 (LC0) to 7.4 (LC3).

TABLE 2

| Compositions | | | | | |
|---|---|---|---|---|---|
| Composition | Nicotine (% wt.) | Glycerol (% wt.) | Propylene glycol (% wt.) | Flavor mixture (% wt.) | Molar ratio lactic acid:nicotine |
| LC0 | 4.5 | 47.5 | 47.5 | 0.5 | 0 (no acid) |
| LC2 | 4.4 | 46.7 | 46.7 | 0.5 | 2:3 |
| LC3 | 4.4 | 46.3 | 46.3 | 0.5 | 1:1 |

Figure 6:
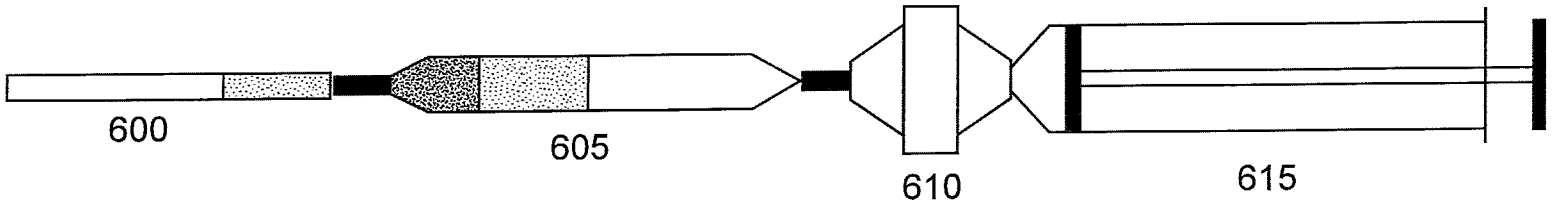
FIG. 6 shows an apparatus for measuring gas/particle partitioning of nicotine.

Each composition was loaded into an electronic cigarette (Kings, NJOY, Inc.) by saturating a fibrous reservoir with the composition liquid to test gas/particle partitioning in aerosols generated from the composition. Gas/particle partitioning of nicotine was measured according to the Canadian Intensive Smoking protocol (55 mL puffs lasting 2 seconds each, every 30 seconds). Gas-phase nicotine was collected on an oxalic acid coated denuder, particle-phase nicotine was collected on an oxalic acid coated filter, and a "puff" was taken by pulling on a syringe downstream of the electronic cigarette, denuder, and filter. FIG. 6 shows the configuration of the testing apparatus including electronic cigarette 600, denuder 605, filter 610, and syringe 615.

Figure 7:
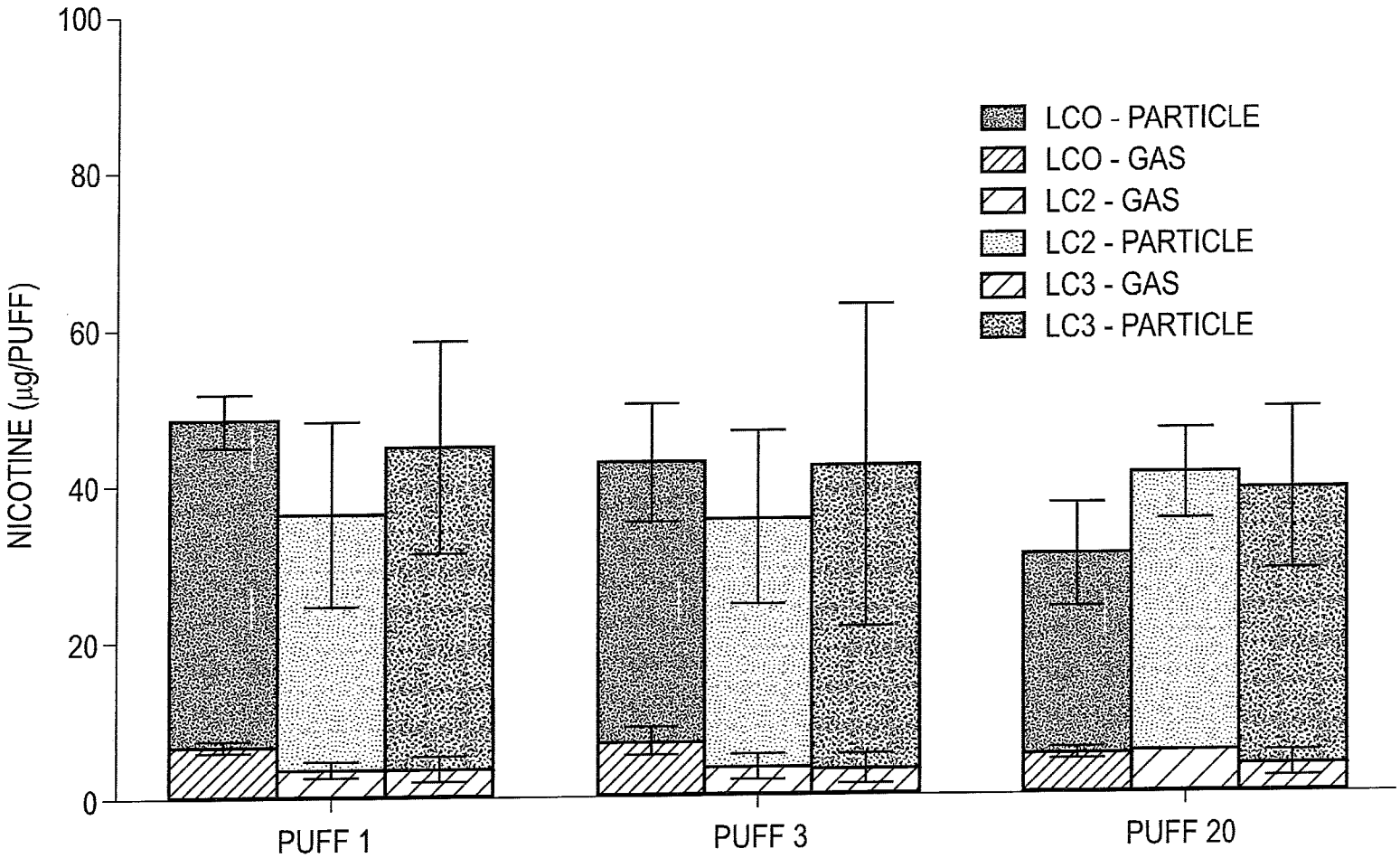
FIG. 7 shows gas-phase and particle-phase concentrations of nicotine in aerosols generated from an electronic cigarette.

Gas and particle samples were collected by drawing a 55 mL "puff" through the syringe over a 2 second period. Immediately following the completion of this "puff," the electronic cigarette was removed and a HEPA filter was installed in its place. Filtered air was then drawn through the denuder and filter at 1.67 L/min for 15 seconds. The denuder was removed and 50 μL of the internal standard (D4-nicotine) was added. The denuder was extracted with 8 mL of 5N NaOH with 2 mL of dichloromethane (DCM). The denuder (with the extraction solvents) was capped and rotated for 5 minutes. The extraction solvents were then transferred to a glass vial and allowed to separate. A 200 μl, sample of the DCM layer was removed for analysis by GC-MS. The filter was placed into a 7 mL glass vial and 50 μL of the internal standard (D4-nicotine) was added. The filter was extracted with 3 mL of 5N NaOH with 1 mL of DCM. The filter (with the extraction solvents) was rotated for 30 minutes. The extraction solvents were then transferred to a microtube and allowed to separate. A 200 μL sample of the DCM layer was removed for analysis by GC-MS. Results are shown in Table 3 and FIG. 7.

TABLE 3

| Average (n = 3) nicotine concentration in gas and particle phases | | | | | | | | | |
|---|---|---|---|---|---|---|---|---|---|
| | LC0 | | | LC2 | | | LC3 | | |
| Puff | Gas (μg) | Particle (μg) | % in particle phase | Gas (μg) | Particle (μg) | % in particle phase | Gas (μg) | Particle (μg) | % in particle phase |
| 1 | 6.77 | 41.59 | 86.0% | 3.87 | 32.67 | 89.4% | 3.8 | 41.1 | 91.5% |
| 3 | 7.18 | 35.64 | 83.2% | 3.89 | 31.80 | 89.1% | 3.6 | 38.7 | 98.5% |
| 20 | 5.28 | 25.62 | 82.9% | 5.53 | 35.64 | 86.6% | 3.9 | 35.2 | 90.0% |

The addition of lactic acid to compositions LC2 and LC3 resulted in greater partitioning of nicotine into the particle phase relative to the gas phase.

Example 2

Dose-Response

Compositions ("Product A," "Product B," and "NJ-001") were prepared according to Table 4 by combining glycerol (≥99.5% w/w, Aldrich), propylene glycol (≥99.5%, Aldrich), nicotine (≥99%, Aldrich), and a flavor mixture; DL-lactic acid (USP, Fisher) was also added as an ion pairing agent in Products A and B.

TABLE 4

| Compositions | | | | | |
|---|---|---|---|---|---|
| Composition | Nicotine (% wt.) | Glycerol (% wt.) | Propylene glycol (% wt.) | Flavor mixture (% wt.) | Molar ratio lactic acid:nicotine |
| Product A | 4.4 | 46.9 | 46.9 | 0.5 | 1:2 |
| Product B | 4.4 | 46.5 | 46.5 | 0.5 | 5:6 |
| NJ-001 | 4.5 | 47.5 | 47.5 | 0.5 | 0 (no acid) |

Each composition was loaded into an electronic cigarette (Kings, NJOY, Inc.) by saturating a fibrous reservoir with the composition liquid, and the electronic cigarettes were administered to subjects for dose-response studies. Baseline data for the total 26 subjects are shown in Table 5. The subjects evaluated both Product A and Product B during a one week ad libitum trial outside the clinical setting, then abstained from all forms of nicotine for 12 hours prior to pharmacokinetic/pharmacodynamic clinical testing of the same product used the previous week.

TABLE 5

| Baseline data for dose-response studies | | | | | | |
|---|---|---|---|---|---|---|
| | N | Mean | SEM | Median | Min | Max |
| Age of subjects | | 44.1 | 2.46 | 44 | 23 | 63 |
| Cigarettes/day smoked within the previous year | | 17.1 | 1.20 | 16 | 10 | 30 |
| Years of smoking cigarettes | | 22.3 | 2.61 | 22 | 3 | 45 |
| Fagerström Test of Nicotine Dependence (FTND) total | | 5.3 | 0.41 | 6 | | |
| Smoked menthol, non-menthol | 7, 19 | | | | | |
| Previous quit attempts | | | | 2 | 0 | 10 |
| Carbon monoxide (ppm) | | 17.9 | 1.69 | 14 | 10 | 35 |
| Blood pressure, systolic (mmHg) | | 111.6 | 2.31 | 110 | 91 | 135 |

TABLE 5-continued

| Baseline data for dose-response studies | | | | | | |
|---|---|---|---|---|---|---|
| | N | Mean | SEM | Median | Min | Max |
| Blood pressure, diastolic (mmHg) | | 72.1 | 1.78 | 72 | 54 | 88 |
| Heart rate (bpm) | | 81.2 | 2.37 | 83 | 54 | 103 |

Blood Nicotine Level

Figure 8:
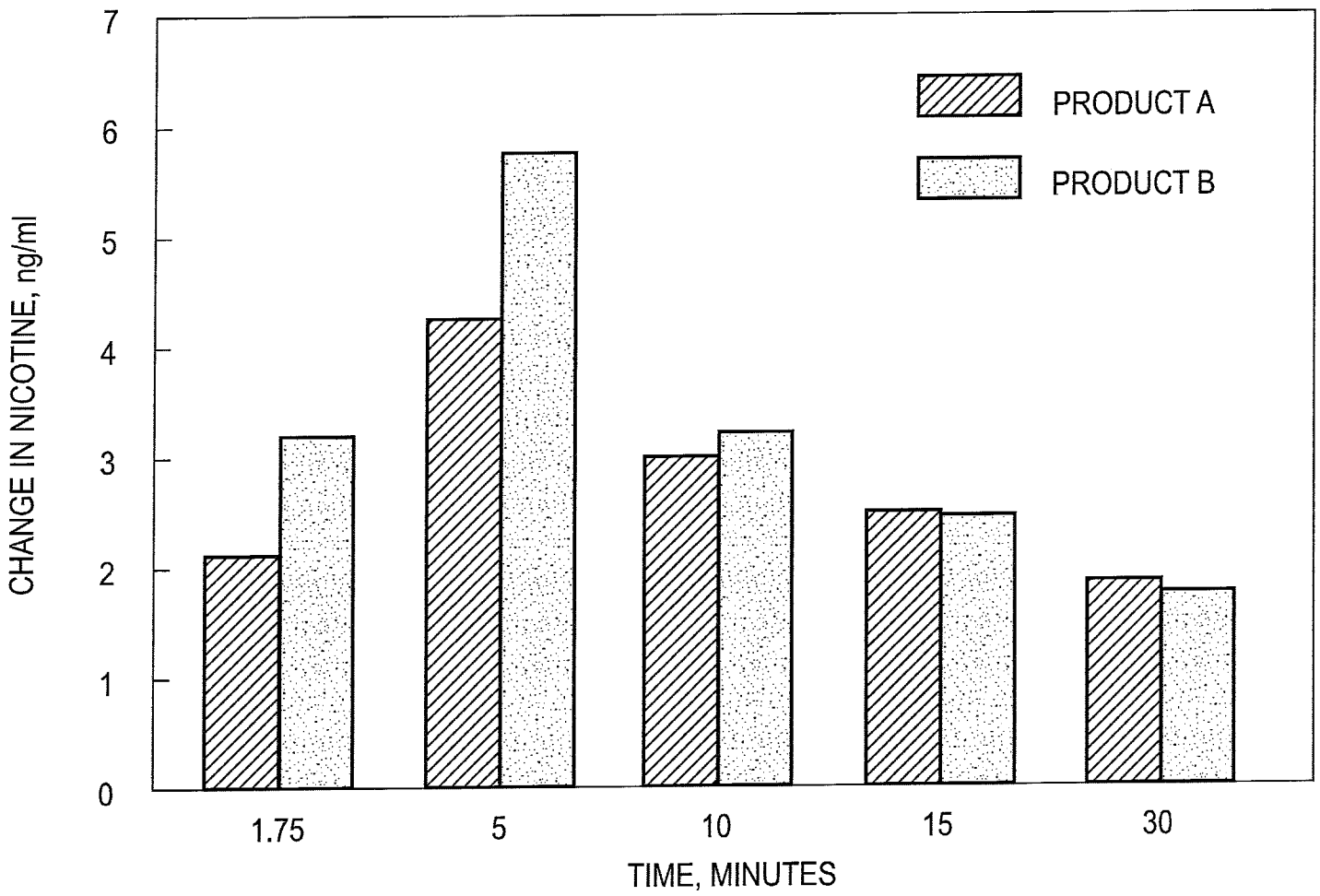
FIG. 8 shows change in nicotine blood level (ng/mL) of subjects at different times after using an electronic cigarette.

Plasma blood levels of nicotine, heart rate, and craving for cigarettes were measured at various time points pre- and post-completion of 10 puffs with an inter-puff-interval of 30 seconds. FIG. 8 shows the change in blood nicotine (ng/mL) from a baseline level measured 5 minutes before the first puff. The lower limit of quantification (LLOQ) of the nicotine assay (LabCorp) was 1.0 ng/mL. The subjects with undetectable levels of nicotine were assigned a value of 0.5 ng/mL (LLOQ/2). For Product A, 21/26 subjects had baseline levels of 0.5 ng/mL; for Product B, 19/26 subjects had baseline levels of 0.5 ng/mL. Results are shown in FIG. 8. Nicotine blood levels for Product B were significantly higher than Product A (paired t-test p=0.037 at 1.75 minutes and p=0.040 at 5 minutes).

Figure 9:
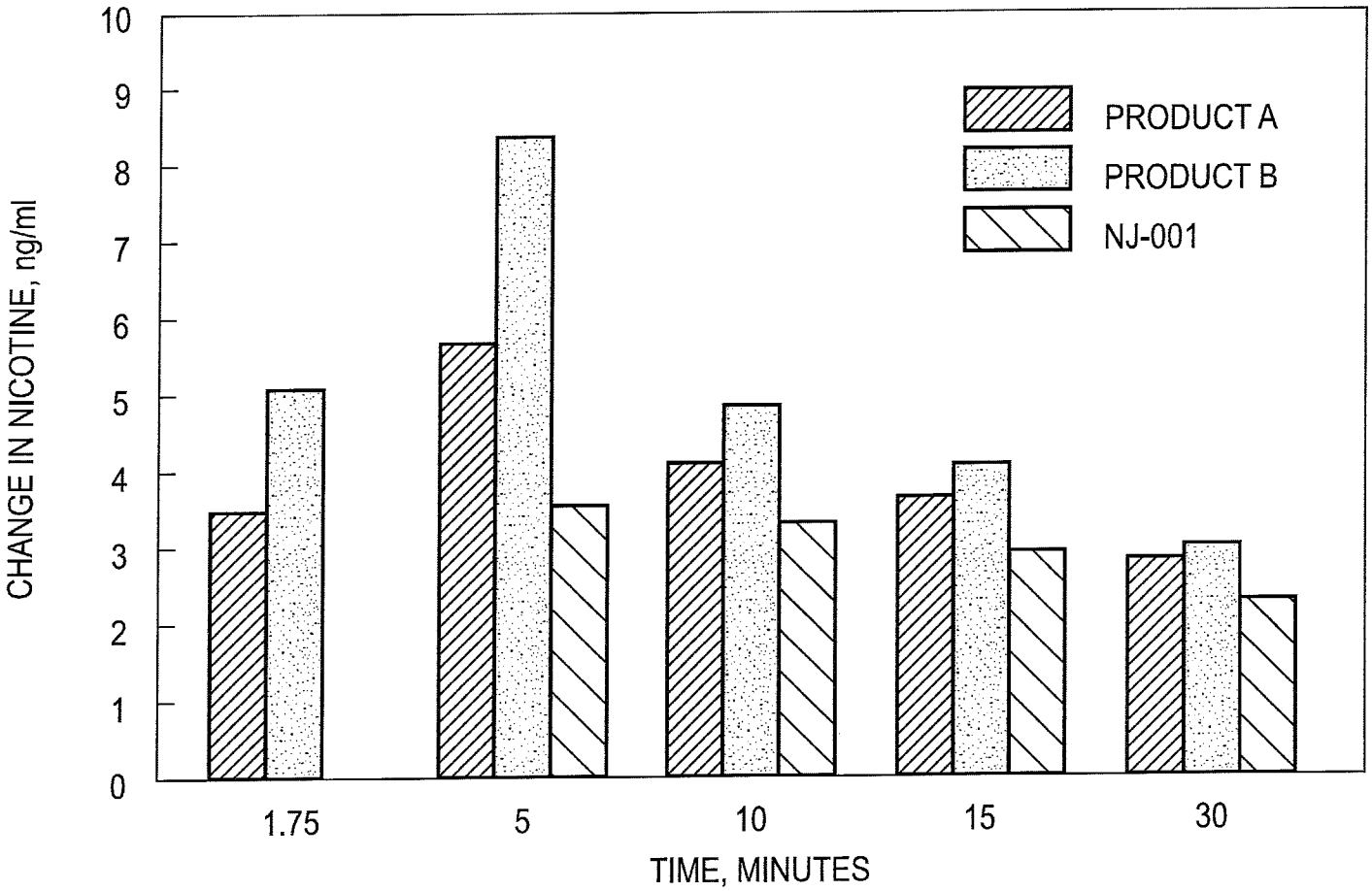
FIG. 9 shows change in nicotine blood level (ng/mL) of subjects at different times after using an electronic cigarette.

Eleven of the subjects also tested product NJ-001 (without lactic acid as ion pairing agent) with blood samples tested at 5, 10, 15, and 30 minutes. Results for those 11 subjects are shown in FIG. 9, and show that nicotine blood levels for Products A and B were significantly higher than NJ-001 (paired t-test p=0.16 for Product B and Product A at 5 minutes; and p=0.003 for Product B vs. NJ-001 at 5 minutes) (data at 1.75 minutes were not collected for NJ-001). The nicotine levels at 5 minutes for Products A and B for this subgroup of 11 subjects were higher than for the whole sample of 26.

Heart Rate

Figure 10:
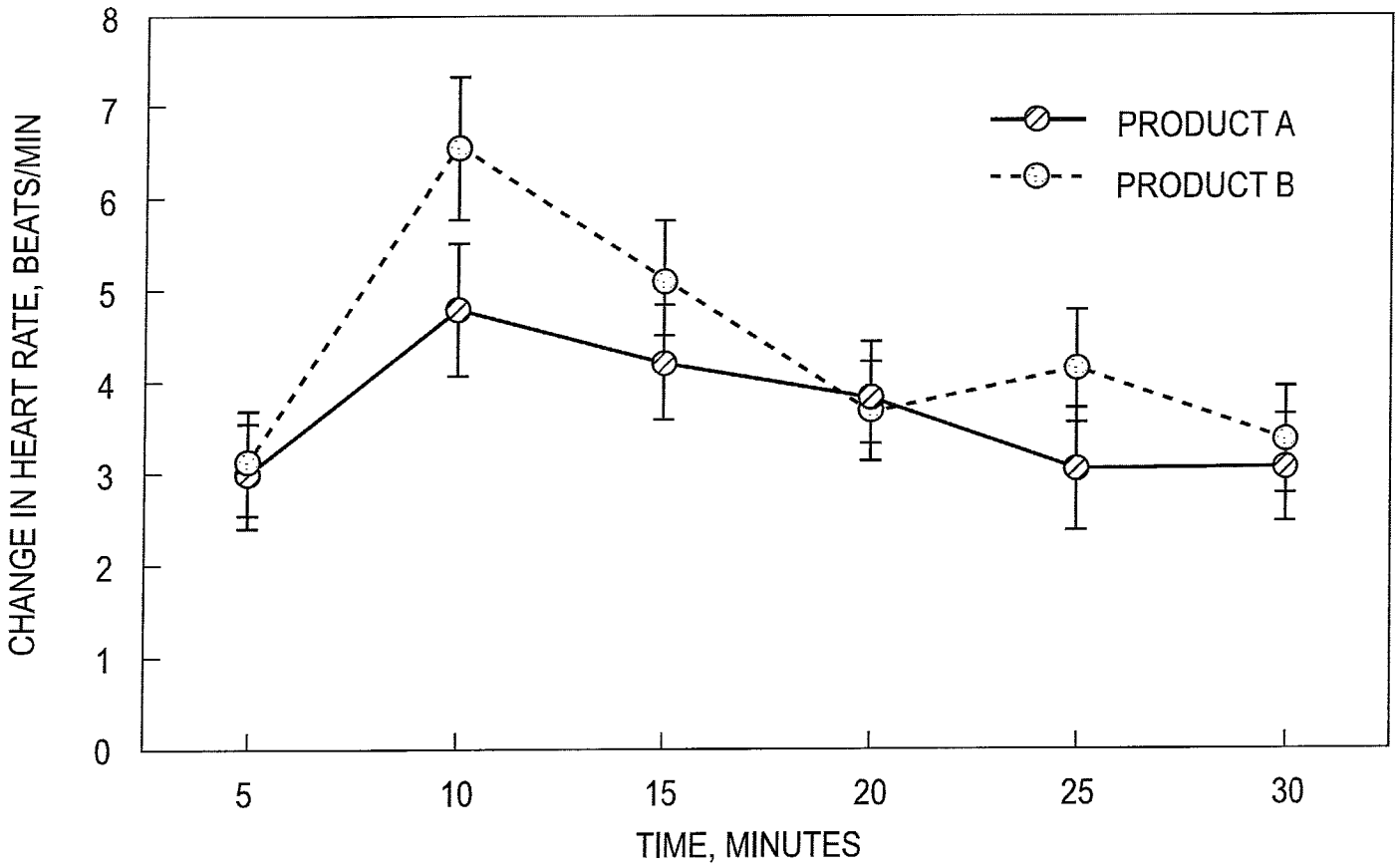
FIG. 10 shows change in heart rate (bpm) of subjects at different times after using an electronic cigarette.

The heart rates of subjects testing Products A and B were recorded every 20 seconds beginning 5 minutes before the first puff of each session. FIG. 10 shows the mean heart rate change (bpm) from baseline over 5 minute periods up to 30 minutes after the first puff. For both Products A and B, heart rate was observed to increase through the first 10 minutes, and then gradually decrease but remain elevated at the 30 minute mark. Product B showed a greater increase in heart rate than Product A as would be expected from the higher nicotine blood levels. This indicates that addition of lactic acid as an ion-pairing agent accelerates both the pharmacokinetics and the pharmacodynamic action of nicotine.

Craving

Figure 11:
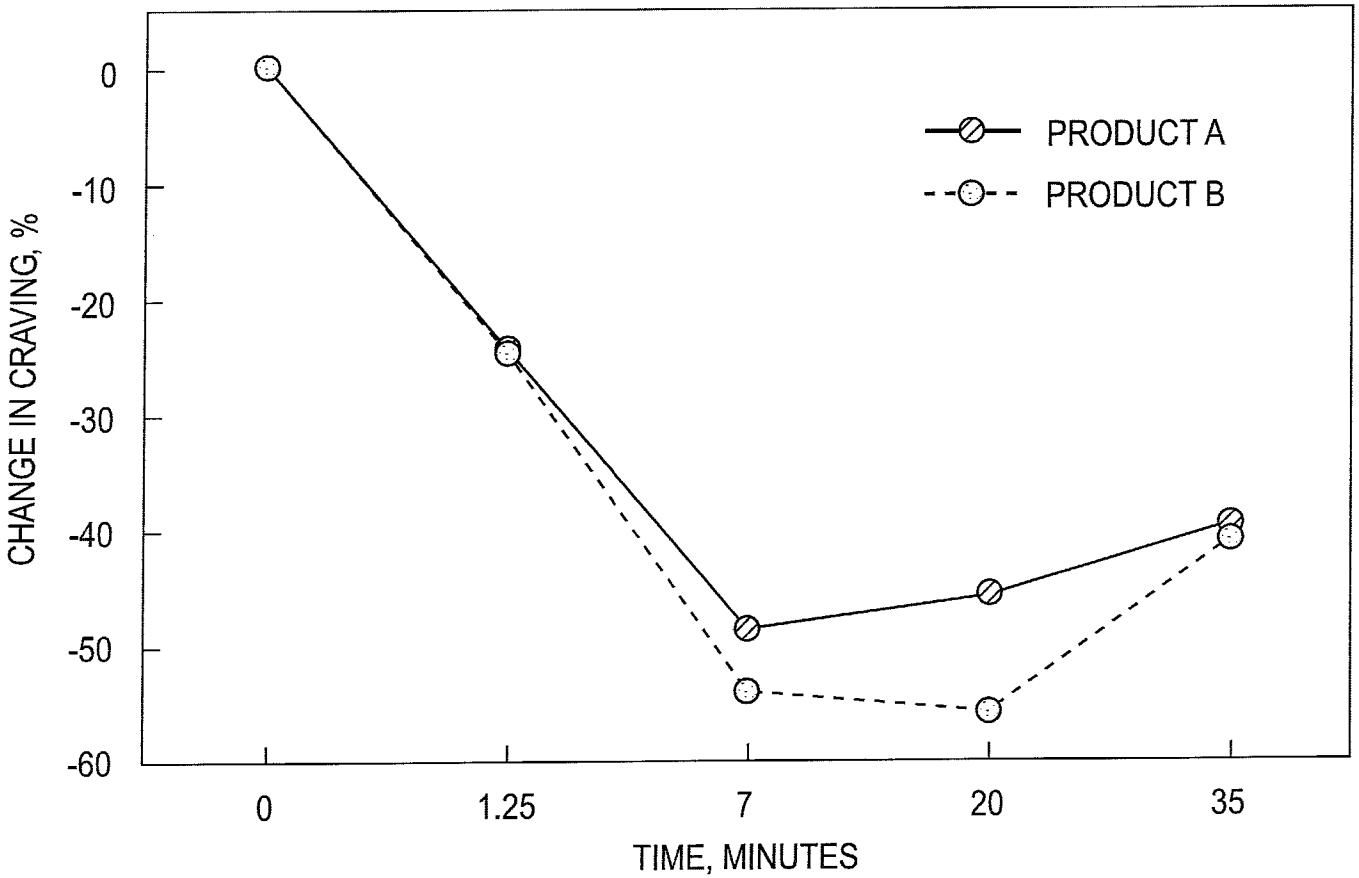
FIG. 11 shows change in craving (%) of subjects at different times after using an electronic cigarette.

Craving was assessed with the 5-item modified version of the Questionnaire of Smoking Urges—Brief, where each visual analog scale (VAS) item has a scale ranging from 1 to 100. Scores for the 5 items were averaged to produce a single craving score for each time period. FIG. 11 shows the mean percent change in craving from baseline for Products A and B. Four of the 26 subjects were excluded from the analysis because their baseline craving was less than 20 on at least one of the test sessions. For subjects with very low baseline craving, taking puffs from the electronic cigarette may act as a priming agent, resulting in higher subsequent craving scores. Craving was reduced by an average of 25% after 4 puffs (1.25 minutes), and by 50% after 7 minutes (2.5 minutes after the last puff). Overall, Product B resulted in greater craving reduction, indicating that addition of the ion-pairing agent improved craving relief.

User Experience

Figure 12:
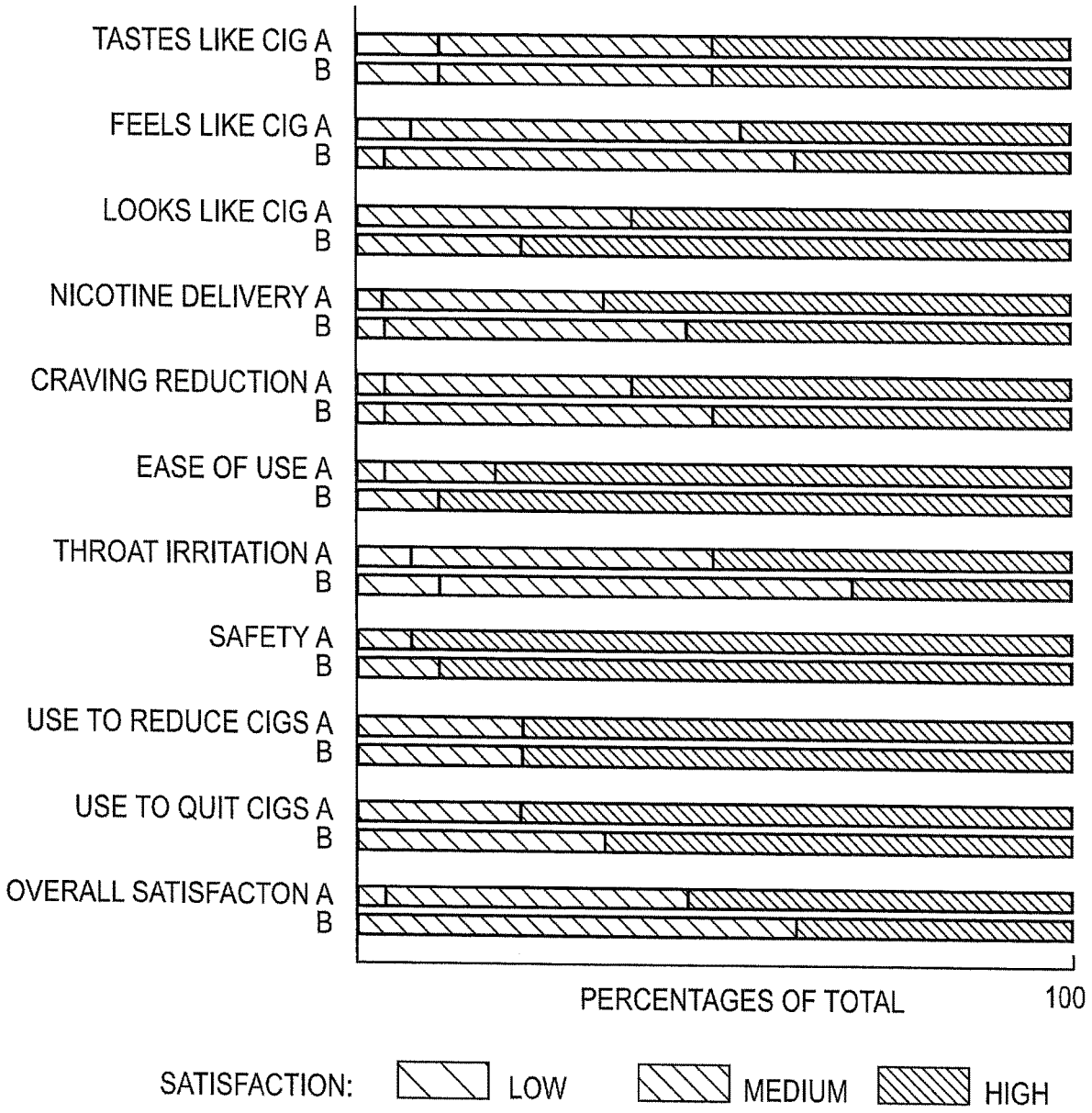
FIG. 12 shows results of a product perception study.
Figure 13:
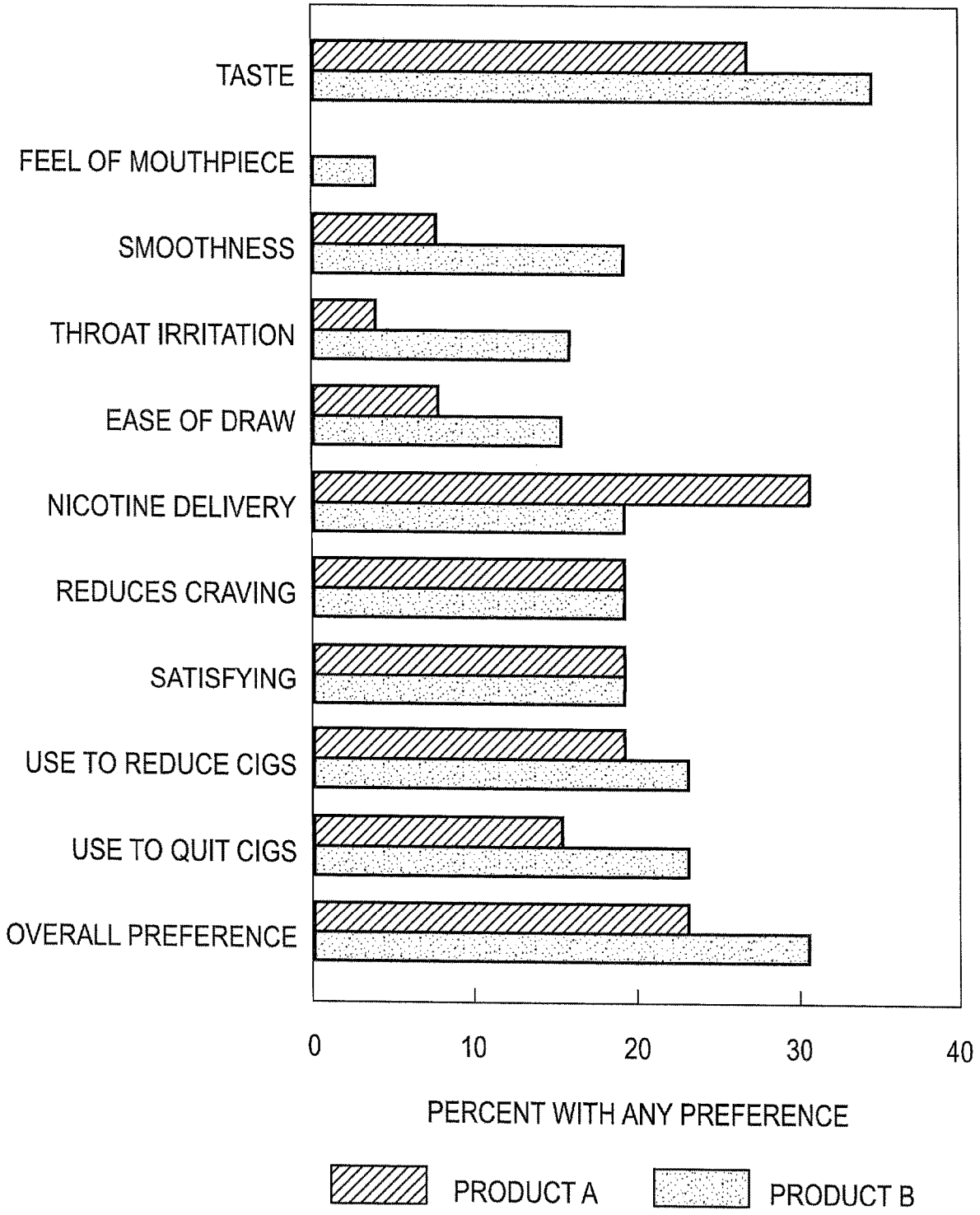
FIG. 13 shows results of a product perception study.

After each week-long ad libitum trial, subjects completed a product perceptions questionnaire for the product they used the previous week. Results are shown in FIGS. 8 and 9. Subjects responded to each item in FIG. 12 on a 7 point Likert-type scale, with 1 representing extremely unsatisfied and 7 representing extremely satisfied. The responses were designated low (1-2), medium (3-5), or high (6-7) satisfaction. FIG. 13 shows results of the subjects making a direct comparison of Products A and B. Overall, Product B, which contained a higher concentration of ion-pairing agent, was preferred.

Example 3

Alkaloid Mixture

Compositions 1-12 are prepared according to Table 6 by combining nicotine (≥99%, Aldrich) with a solvent mixture comprising glycerol (≥99.5% w/w, Aldrich), propylene glycol (≥99.5%, Aldrich), and/or PEG 400 (Aldrich); DL-lactic acid (USP, Fisher); and a flavor mixture. Menthol is added to compositions 2, 4, 6, 8, 10, and 12. An alkaloid mixture of myosmine, anatabine, and anabasine is added to compositions 7 and 8, wherein the mixture comprises myosmine in a 1:40 molar ratio with respect to nicotine (myosmine:nicotine), anatabine in a 1:40 molar ratio with respect to nicotine (anatabine:nicotine), and anabasine in a 1:300 molar ratio with respect to nicotine (anabasine:nicotine). The pH of each composition is measured with a pH meter; pH values range from 7.7 to 7.8.

TABLE 6

| | Compositions | | | | | |
|---|---|---|---|---|---|---|
| | Nicotine (% wt) | Glycerol (% wt.) | Propylene glycol (% wt.) | PEG 400 (% wt.) | Lactic acid (% wt.) | Flavorings (0.5% general flavor agents + additional as listed) |
| 1 | 3.0 | 47.6 | 47.6 | — | 1.4 | |
| 2 | 3.0 | 46.5 | 46.5 | — | 1.4 | Menthol 2.2% |
| 3 | 4.5 | 46.9 | 46.9 | — | 1.2 | |
| 4 | 4.5 | 45.4 | 45.4 | — | 2.1 | Menthol 2.2% |
| 5 | 7.0 | 44.6 | 44.6 | — | 3.2 | |
| 6 | 7.0 | 43.5 | 43.5 | — | 3.2 | Menthol 2.2% |
| 7 | 4.5 | 46.2 | 46.2 | — | 2.5 | Alkaloid mixture (as above) |
| 8 | 4.5 | 45.1 | 45.1 | — | 2.5 | Alkaloid mixture (as above); Menthol 2.2% |
| 9 | 3.0 | 47.6 | — | 47.6 | 1.4 | |
| 10 | 3.0 | 46.5 | — | 46.5 | 1.4 | Menthol 2.2% |
| 11 | 4.5 | 46.9 | — | 46.9 | 1.2 | |
| 12 | 4.5 | 45.4 | — | 45.4 | 2.1 | Menthol 2.2% |

Each composition is loaded into an electronic cigarette (Kings, NJOY, Inc.) by saturating a fibrous reservoir with the composition liquid for use as an alternative vaporizing device.

Example 4

Vapor Output with and without Ion Pairing Agent

Compositions ("NJOY-AB," "NJOY-TB") were prepared according to Table 7 by combining glycerol (≥99.5% w/w, Aldrich), propylene glycol (≥99.5%, Aldrich), water, nicotine (≥99%, Aldrich), and a flavor mixture. A monocarboxylic acid, DL-lactic acid (USP, Fisher), was added as an ion pairing agent in NJOY-AB, but not in NJOY-TB. The nicotine concentration was selected, based on user feedback, to result in a throat hit or impact comparable to, or modestly exceeding, the throat impact of typical full-strength commercial cigarettes (e.g., Marlboro Red). Water was added to the NJOY-AB composition to control solubility and viscosity. The higher nicotine concentration in the NJOY-AB composition as compared to the NJOY-TB composition for a given level of throat impact reflects the ability of the lactic acid ion pairing agent to reduce or mitigate throat impact.

TABLE 7

| Compositions | | | | | | |
|---|---|---|---|---|---|---|
| Composition | Nicotine (% wt.) | Glycerol (% wt.) | Propylene glycol (% wt.) | Flavor mixture (% wt.) | Water (% wt.) | Molar ratio lactic acid:nicotine |
| NJOY-AB | 6.4 | 40 | 40 | 0.5 | 10 | 5:6 |
| NJOY-TB | 4.5 | 46.5 | 46.5 | 0.5 | 0 | No lactic acid |

The compositions were loaded into an electronic cigarette (Kings, NJOY, Inc., equipped with a 2.4 ohm resistance heating wire) by saturating a fibrous reservoir with the composition liquid. The electronic cigarettes were administered to subjects (N=20) for pharmacokinetic and nicotine craving relief studies. All subjects were smokers of traditional (combustion) cigarettes having a preferred brand of cigarette with about 5% to 6% nicotine by weight. The subjects evaluated both NJOY-AB and NJOY-TB during a one week ad libitum trial outside the clinical setting, after which they abstained from all forms of nicotine for 12 hours prior to pharmacokinetic/pharmacodynamic clinical testing of the same electronic cigarette used the previous week. The subjects also evaluated their preferred brand of cigarette according to the same protocol (i.e., a one week ad libitum trial outside the clinical setting, followed by abstaining from all forms of nicotine for 12 hours prior to pharmacokinetic/pharmacodynamic clinical testing).

Blood Nicotine Level

Figure 14:
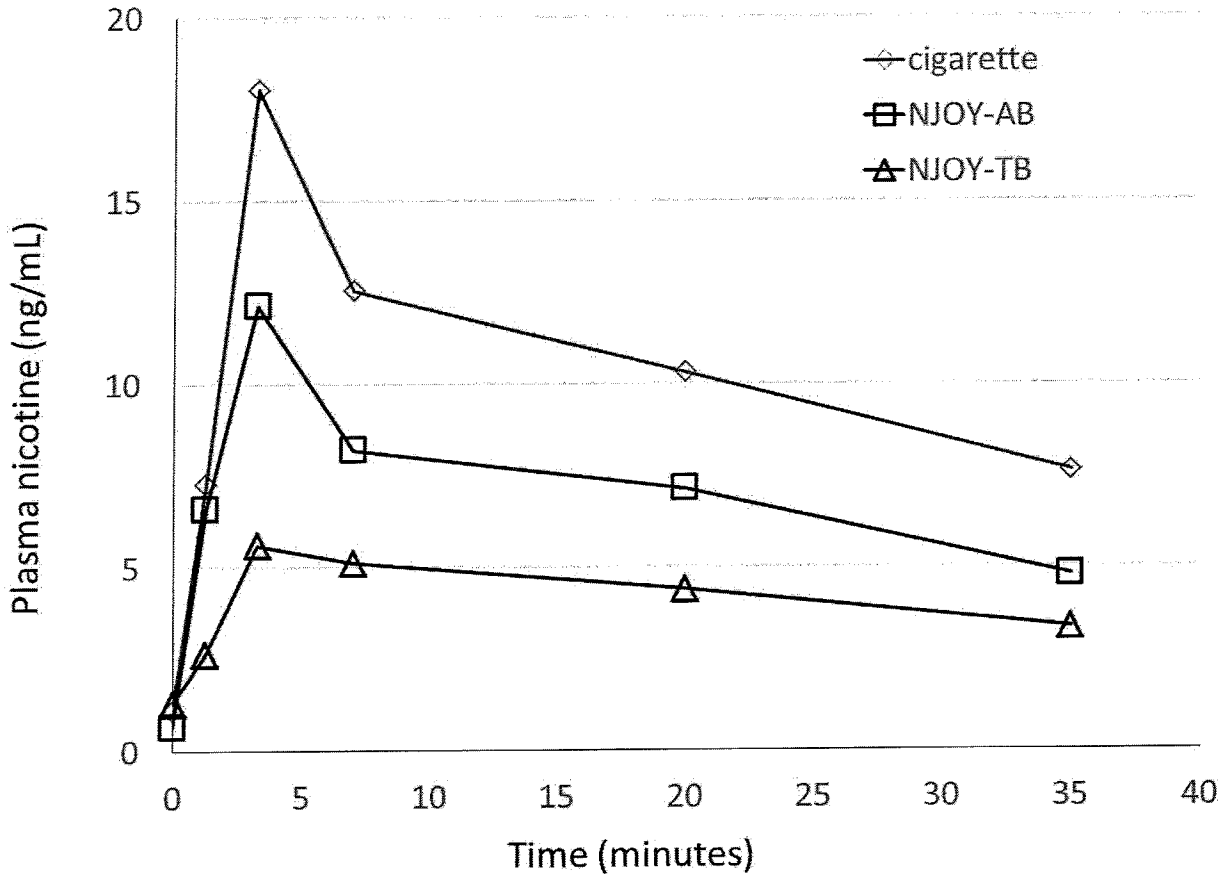
FIG. 14 shows nicotine blood levels (ng/mL) of subjects at different times after using electronic cigarettes in comparison to a traditional cigarette.

Plasma blood levels of nicotine and craving for cigarettes were measured at various time points pre- and post-completion of 10 puffs with an inter-puff interval of 30 seconds, for each of NJOY-AB, NJOY-TB, and the subject's preferred brand of traditional combustion cigarette. FIG. 14 shows the blood nicotine level (ng/mL) of the subjects, with t=0 reflecting the baseline level measured approximately 5 minutes before the first puff. The lower limit of quantification (LLOQ) of the nicotine assay (LabCorp) was 1.0 ng/mL.

As shown in FIG. 14, nicotine blood levels for NJOY-AB, which comprised lactic acid as an ion pairing agent, exceeded 5 ng/mL for the majority of the testing period (35 minutes), and exceeded 10 ng/mL for several minutes shortly after the first inhalation (from about 3 minutes to about 6 minutes after the first inhalation). This is particularly notable in comparison to current vaporizing devices and compositions, which have not provided users with blood nicotine levels substantially greater than 5 ng/mL when subjected to similar testing of sequential puffs. Nicotine blood levels for NJOY-AB also were significantly higher than for NJOY-TB, which did not comprise an ion pairing agent (paired t-test p=0.001 at 1.75 minutes and p=0.0003 at 5 minutes). Thus, for a fixed degree of throat impact, addition of a monocarboxylic acid ion pairing agent was found to enhance systemic nicotine delivery.

Moreover, as shown in FIG. 14, the temporal pattern of blood levels for NJOY-AB was similar to that of the traditional combustion cigarettes, with NJOY-AB achieving a maximum shortly before the combustion cigarettes. NJOY-TB resulted in slower nicotine delivery in comparison to both the combustion cigarettes and NJOY-AB, e.g., resulting in less rapid rise in blood nicotine level over the first few puffs, and less rapid fall in blood nicotine levels upon stopping puffing. Thus, the monocarboxylic acid ion pairing agent was found to enhance the speed of nicotine delivery, e.g., better mimicking the pharmacokinetics of nicotine delivery from traditional combustion cigarettes.

Craving

Figure 15:
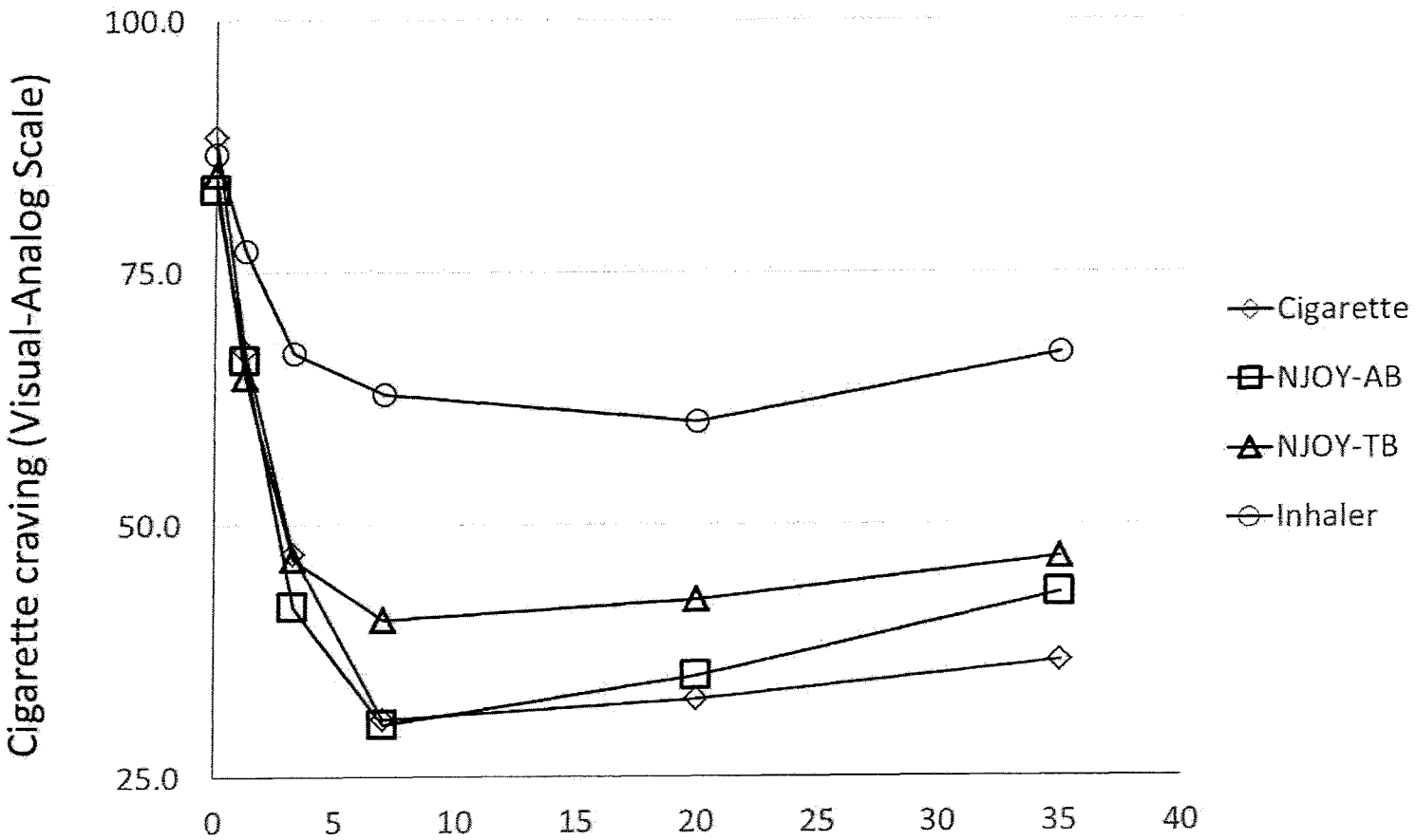
FIG. 15 shows craving relief in subjects after using electronic cigarettes in comparison to a traditional cigarette.

Craving was assessed with the 5-item modified version of the Questionnaire of Smoking Urges, where each visual analog scale (VAS) item has a scale ranging from 1 to 100. Scores for the 5 items were averaged to produce a single craving score for each time period. FIG. 15 shows the mean percent change in craving from baseline for NJOY-AB and NJOY-TB, compared to a FDA-approved smoking cessation drug product (Nicotrol Inhaler) and to the users' respective preferred brands of traditional combustion cigarette. For NJOY-AB, craving was reduced by an average of 64% after 7 minutes (2.5 minutes after the last puff), a reduction comparable to smoking the users' preferred brands of cigarette, and exceeding by more than 2-fold the Nicotrol Inhaler. The reduction in craving produced by NJOY-AB exceeded that produced by NJOY-TB. Thus, addition of the ion pairing agent was found to improve craving relief, resulting in an electronic cigarette providing craving relief comparable to the users' preferred brands of cigarette.

Example 5

Voltage Modulation

An integrated circuit of an electronic cigarette is designed to enable rapid initial vaporization without subsequent overheating. The electronic cigarette also includes a battery having an initial voltage of about 4.2 V when fresh (i.e., before use), and a heating wire as a heating element, wherein the heating wire has a resistance of about 2.0±0.1 ohm, about 2.2±0.1 ohm, or about 2.4±0.1 ohm. The integrated circuit is configured (e.g., programmed) to control the battery so as to operate in a first mode (un-modulated voltage) and a second mode (modulated voltage), such that the effective voltage in the second mode is about 2.8 V, about 2.9 V, or about 3.0 V. The integrated circuit detects the voltage of the battery and implements the following program to control the duration of the first mode:

TABLE 8

| Modulation program | |
|---|---|
| Detected Battery Voltage (V) | Mode 1 Duration (seconds) |
| 4.2 | 0.37 |
| 4.1 | 0.39 |
| 4.0 | 0.41 |
| 3.9 | 0.43 |
| 3.8 | 0.45 |
| 3.7 | 0.47 |
| 3.6 | 0.50 |
| 3.5 | 0.53 |
| 3.4 | 0.56 |
| 3.3 | 0.60 |
| 3.2 | 0.63 |
| 3.1 | 0.67 |
| 3.0 | 0.72 |
| 2.9 | Do not activate |

The duration of operation in the second mode is determined by iteration of user activation of the device (e.g., manually, such as by button pressing, or upon inhalation detected by a sensor). When the detected voltage falls below 2.9 V, the electronic cigarette signals the user that the battery needs to be recharged (or the battery or the electronic cigarette needs to be replaced) and will not activate again until the battery voltage is restored.

Example 6

Vaping of e-Liquid with Ion-Pairing Agent

A composition ("NJOY-AB-V") was prepared combining glycerol (≥99.5% w/w, Aldrich; final percentage 48.4% by wt.), propylene glycol (≥99.5%, Aldrich; final percentage 48.4% by wt.), nicotine (≥99%, Aldrich; final percentage 1.8% by wt.), a flavor mixture (0.5% by wt.), and DL-lactic acid (USP, Fisher; 5:6 molar ratio to nicotine).

The composition was loaded into the clearomizer of a vaping device (3.7V battery, 2.3 ohm heating wire) with push button activation. Pharmacokinetic data were obtained for 3 subjects during an in-laboratory session which followed about one week of ad libitum trial outside the clinical setting. Prior to the in-laboratory session, the 3 subjects were instructed to abstain from all forms of nicotine for 12 hours. Plasma blood levels of nicotine and craving for cigarettes were measured pre-completion and at various time points post-completion of 10 puffs with an inter-puff-interval of 30 seconds.

For the first subject, data were as follows (nicotine in plasma): pre-completion, <1 ng/mL; t=1.75 min, 8.9 ng/mL; t=5 min, 10.2 ng/mL; t=10 min, 5.1 ng/mL; t=15 min, 4.5 ng/mL; and t=30 min, 3.2 ng/mL.

For the second subject, data were as follows (nicotine in plasma): pre-completion, 1.2 ng/mL; t=1.75 min, 6.9 ng/mL; t=5 min, 11.9 ng/mL; t=10 min, 10.3 ng/mL; t=15 min, 5.1 ng/mL; and t=30 min, 4.5 ng/mL.

For the third subject, data were as follows (nicotine in plasma): pre-completion, 4.2 ng/mL; t=1.75 min, 5.0 ng/mL; t=5 min, 12.6 ng/mL; t=10 min, 8.6 ng/mL; t=15 min, 6.2 ng/mL; and t=30 min, 4.7 ng/mL.

Thus, inhalation of as few as 3 puffs of a liquid comprising an ion pairing agent and as little as 1.8% nicotine was found to produce nicotine plasma concentrations greater than 8 ng/mL within 2 minutes. Moreover, inhalation of 10 puffs over 5 minutes was found to routinely produce plasma nicotine concentrations greater than 10 ng/mL, despite the nicotine concentration being only 1.8%. These data are reflective of the ability of the ion pairing agent to enhance systemic nicotine delivery via vaping.

It is intended that the specification and examples be considered as exemplary only, and departure in form and detail may be made without departing from the scope and spirit of the present disclosure as defined by the following claims.

What is claimed is:

1. A liquid composition comprising nicotine, at least one solvent, and at least one ion pairing agent comprising lactic acid;

wherein the lactic acid has a molar ratio with respect to nicotine ranging from about 2:3 to about 1:1; and wherein vaporization and condensation of the composition with an electronic cigarette comprising a battery and a heating element, produces an aerosol having a gas phase and a particulate phase;

wherein at least 85% of the nicotine by weight in the aerosol is partitioned into the particulate phase;

wherein a pH of the composition is within a range of about pH 7 to about pH 8; and wherein the at least one solvent comprises from about 44% to about 48% glycerol and from about 44% to about 48% propylene glycol by weight with respect to the total weight of the composition.

2. The composition of claim 1, wherein the nicotine is not in free base form.

3. The composition of claim 1, wherein a pH of the aerosol is ±0.3 pH of the pH of the composition.

4. The composition of claim 1, further comprising at least one agent chosen from menthol, a tobacco alkaloid compound, a preservative, or a combination thereof, wherein the at least one agent has a molar ratio with respect to nicotine ranging from about 1:200 to about 1:2.

5. The composition of claim 1, comprising from about 1.5% to about 6.0% nicotine.

6. The composition of claim 5, further comprising from about 0.1% to about 3.0% of at least one agent chosen from menthol, a tobacco alkaloid compound, a non-tobacco flavor, or a combination thereof, by weight with respect to the total weight of the composition.

7. A liquid composition comprising nicotine, at least one solvent, and at least one ion pairing agent comprising lactic acid, wherein the lactic acid has a molar ratio with respect to nicotine of about 5:6, wherein vaporization and condensation of the composition with an electronic cigarette comprising a battery and a heating element produces an aerosol having a gas phase and a particulate phase, wherein at least 85% of the nicotine by weight in the aerosol is partitioned into the particulate phase, wherein a pH of the composition is within a range of about pH 7 to about pH 8; and wherein the at least one solvent comprises from about 44% to about 48% glycerol and from about 44% to about 48% propylene glycol by weight with respect to the total weight of the composition.

8. A liquid composition comprising nicotine, at least one solvent, at least one ion pairing agent comprising lactic acid, and at least one agent chosen from chosen from menthol, a tobacco alkaloid compound, a non-tobacco flavor, or a combination thereof;

wherein the lactic acid has a molar ratio with respect to nicotine ranging from about 2:3 to about 1:1, and the at least one agent has a molar ratio with respect to nicotine ranging from about 1:200 to about 1:2;

wherein vaporization and condensation of the composition with an electronic cigarette comprising a battery and a heating element produces an aerosol having a gas phase and a particulate phase;

wherein at least 85% of the nicotine by weight in the aerosol to be partitioned into the particulate phase;

wherein a pH of the composition is within a range of about pH 7 to about pH 8; and wherein the at least one solvent comprises from about 44% to about 48% glycerol and from about 44% to about 48% propylene glycol by weight with respect to the total weight of the composition.

9. The composition of claim 1, wherein the composition comprises about 6.0% nicotine by weight with respect to the total weight of the composition.

10. The composition of claim 4, wherein the composition comprises less than about 2% by weight of the at least one agent.

11. The composition of claim 7, further comprising about 0.1% to about 3.0% of at least one agent chosen from menthol, a tobacco alkaloid compound, a non-tobacco flavor, or a combination thereof, by weight with respect to the total weight of the composition.

12. The composition of claim 7, wherein the composition comprises about 4.5% or about 6.0% nicotine by weight with respect to the total weight of the composition.

13. The composition of claim 7, wherein the composition comprises about 1.0% or about 1.5% nicotine by weight with respect to the total weight of the composition.

14. The composition of claim 8, wherein the at least one agent comprises menthol, at least one tobacco alkaloid chosen from nornicotine, myosmine, anabasine, nicotyrine, metanicotine, anatabine, nornicotyrine, or continine, or a combination thereof.

15. The composition of claim 8, wherein the at least one agent comprises menthol, and the molar ratio of menthol to nicotine is about 1:100 to about 1:50.

16. The composition of claim 8, wherein the molar ratio of lactic acid to nicotine ranges from about 3:4 to about 5:6.

17. A composition comprising:

from about 1.5% to about 6.0% nicotine by weight with respect to the total weight of the composition;

lactic acid, wherein a molar ratio of the lactic acid with respect to nicotine ranges from about 2:3 to about 1:1;

at least one agent chosen from menthol, a tobacco alkaloid compound, a non-tobacco flavor, or a combination thereof, the at least one agent having a molar ratio relative to nicotine of about 1:50 to about 1:400; and at least one solvent comprising from about 44% to about 48% glycerol and from about 44% to about 48% propylene glycol by weight with respect to the total weight of the composition;

wherein vaporization and condensation of the composition with an electronic cigarette comprising a battery and a heating element produces an aerosol having a gas phase and a particulate phase;

wherein at least 85% of the nicotine by weight in the aerosol is partitioned into the particulate phase; and wherein a pH of the composition is within a range of about pH 7 to about pH 8.

18. The method of claim 1, wherein the at least one solvent comprises about 45% glycerol and about 45% polyethylene glycol by weight with respect to the total weight of the composition.

19. The method of claim 7, wherein the at least one solvent comprises about 45% glycerol and about 45% polyethylene glycol by weight with respect to the total weight of the composition.

20. The method of claim 8, wherein the at least one solvent comprises about 45% glycerol and about 45% polyethylene glycol by weight with respect to the total weight of the composition.

21. The method of claim 17, wherein the at least one solvent comprises about 45% glycerol and about 45% polyethylene glycol by weight with respect to the total weight of the composition.

* * * * *